US010667053B2

(12) United States Patent
Nakagawa et al.

(10) Patent No.: US 10,667,053 B2
(45) Date of Patent: May 26, 2020

(54) SOUND REPRODUCING APPARATUS AND METHOD, AND PROGRAM

(71) Applicant: Sony Corporation, Tokyo (JP)

(72) Inventors: Toshiyuki Nakagawa, Kanagawa (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/087,186

(22) PCT Filed: Mar. 17, 2017

(86) PCT No.: PCT/JP2017/010869
§ 371 (c)(1),
(2) Date: Sep. 21, 2018

(87) PCT Pub. No.: WO2017/169888
PCT Pub. Date: Oct. 5, 2017

(65) Prior Publication Data

US 2019/0104362 A1 Apr. 4, 2019

(30) Foreign Application Priority Data

Mar. 31, 2016 (JP) ..... 2016-072169

(51) Int. Cl.
*H04R 3/04* (2006.01)
*H04R 3/12* (2006.01)
(Continued)

(52) U.S. Cl.
CPC ..... *H04R 3/04* (2013.01); *H04R 1/403* (2013.01); *H04R 3/007* (2013.01); *H04R 3/12* (2013.01);
(Continued)

(58) Field of Classification Search
CPC . H04R 3/04; H04R 3/007; H04R 5/02; H04R 5/04; H04R 2420/03; H04S 7/303
(Continued)

(56) References Cited

U.S. PATENT DOCUMENTS 6,151,401 A * 11/2000 Annaratone ..... G06F 1/1616 361/679.23
6,794,798 B2 * 9/2004 Watanabe ..... H04R 5/02 310/334
(Continued)

FOREIGN PATENT DOCUMENTS

JP 11-75284 A 3/1999
JP 2002-359890 A 12/2002
(Continued)

OTHER PUBLICATIONS

International Search Report and Written Opinion and English translations thereof dated Jun. 6, 2017 in connection with International Application No. PCT/JP2017/010869.
(Continued)

*Primary Examiner* — David L Ton
(74) *Attorney, Agent, or Firm* — Wolf, Greenfield & Sacks, P.C.

(57) ABSTRACT

The present technology relates to a sound reproducing apparatus and method, and a program that enable sound reproduction with high sound quality and excellent directivity characteristics at lower costs.
A sound reproducing apparatus includes: an amplification unit that amplifies an acoustic signal; a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among
(Continued)

the plurality of electroacoustic transducers to the amplification unit. The present technology can be applied to a sound reproducing apparatus, for example.

20 Claims, 19 Drawing Sheets

(51) Int. Cl.

| | |
|---|---|
| ***H04R 1/40*** | (2006.01) |
| ***H04R 3/00*** | (2006.01) |
| ***H04R 5/02*** | (2006.01) |
| ***H04R 5/04*** | (2006.01) |
| ***H04R 19/02*** | (2006.01) |
| ***H04R 17/00*** | (2006.01) |
| ***H04S 7/00*** | (2006.01) |

(52) U.S. Cl.
CPC ..... *H04R 5/02* (2013.01); *H04R 5/04* (2013.01); *H04S 7/303* (2013.01); *H04R 17/00* (2013.01); *H04R 19/02* (2013.01); *H04R 2203/12* (2013.01); *H04R 2420/03* (2013.01); *H04R 2430/20* (2013.01); *H04R 2499/11* (2013.01)

(58) Field of Classification Search
USPC ..... 381/123, 173, 174
See application file for complete search history.

(56) References Cited

U.S. PATENT DOCUMENTS 8,503,700 B2 * 8/2013 Fujise ..... H04R 7/06 381/162
8,953,824 B2 * 2/2015 Park ..... H04N 5/607 381/306
9,807,535 B2 * 10/2017 Bostick ..... H04S 7/301
9,843,881 B1 * 12/2017 Oates, III ..... H04S 7/301
10,264,348 B1 * 4/2019 Harris ..... H04R 17/10
2002/0141164 A1 10/2002 Watanabe et al.
2007/0064955 A1 * 3/2007 Saito ..... H04R 5/04 381/58
2010/0061573 A1 * 3/2010 Fujise ..... H04R 3/04 381/190
2010/0111336 A1 * 5/2010 Jeong ..... H04R 5/04 381/306
2011/0051937 A1 * 3/2011 Ma ..... H04R 5/02 381/17
2012/0183162 A1 * 7/2012 Chabanne ..... H04N 5/642 381/306
2012/0185769 A1 * 7/2012 Whitley ..... H04H 60/04 715/716
2013/0058503 A1 3/2013 Kato et al.
2014/0270305 A1 * 9/2014 Baym ..... H04R 1/403 381/334
2014/0341418 A1 * 11/2014 Kwong ..... H04R 1/025 381/386
2014/0369514 A1 * 12/2014 Baym ..... H04R 1/403 381/71.1
2015/0036848 A1 * 2/2015 Donaldson ..... H04S 7/303 381/303
2015/0382129 A1 * 12/2015 Florencio ..... H04S 7/303 381/303

FOREIGN PATENT DOCUMENTS

JP 2006-114990 A 4/2006
JP 2008-258815 A 10/2008
JP 2009-65427 A 3/2009
JP 2013-57705 A 3/2013

OTHER PUBLICATIONS

International Preliminary Report on Patentability and English translation thereof dated Oct. 11, 2018 in connection with International Application No. PCT/JP2017/010869.

* cited by examiner

SOUND REPRODUCING APPARATUS AND METHOD, AND PROGRAM

CROSS-REFERENCE TO RELATED APPLICATIONS

This application claims the benefit under 35 U.S.C. § 371 as a U.S. National Stage Entry of International Application No. PCT/JP2017/010869, filed in the Japanese Patent Office as a Receiving Office on Mar. 17, 2017, which claims priority to Japanese Patent Application Number JP2016-072169, filed in the Japanese Patent Office on Mar. 31, 2016, each of which is hereby incorporated by reference in its entirety.

TECHNICAL FIELD

The present technology relates to a sound reproducing apparatus and method, and a program, and more particularly, to a sound reproducing apparatus and method, and a program that enable sound reproduction with high sound quality and excellent directivity characteristics at lower costs.

BACKGROUND ART

When sound is reproduced, for example, a waveform signal is converted into an electrical signal, and a drive system is driven by the electrical signal, to emit the sound.

The conversion process for performing acoustic radiation from an electronic circuit through an oscillation system is called electroacoustic transduction, and elements and devices that perform electroacoustic transduction are called electroacoustic transducers. For example, speakers, headphones, and the like are electroacoustic transducers.

Speakers that are widely used at the present time are electrodynamic or dynamic speakers. Speakers of other types include piezoelectric speakers, electrostatic speakers, and the like.

An electroacoustic transducer of an electrodynamic type takes advantage of the fact that, when an object electrified in a vertical direction is placed in a uniform magnetic field, force is generated in the object in a direction perpendicular to the magnetic field and the current.

An acoustic signal has an alternating current and a variable current direction. Therefore, the direction of the force changes, and the object (an electrical conductor) vibrates with the change. Such an electroacoustic transducer is called a dynamic speaker.

Meanwhile, a piezoelectric electroacoustic transducer takes advantage of the fact that, when voltage is applied from an external power supply to a structure formed by bonding a metal diaphragm to a piezoelectric crystal plate, electrostatic force acts on the positive and negative ions that constitutes the piezoelectric crystal plate, and stress is generated to distort the crystal.

For example, the piezoelectric crystal plate is subjected to stress that acts to widen the area. However, one side of the piezoelectric crystal plate is constrained by the metal diaphragm, and therefore, the piezoelectric crystal plate expands, to cause warpage in the metal diaphragm. Further, if the voltage direction is reversed, the piezoelectric crystal plate is subjected to stress that acts to narrow the area. However, one side of the piezoelectric crystal plate is constrained by the metal diaphragm. Therefore, the piezoelectric crystal plate shrinks, and the metal diaphragm warps toward the opposite side. Such an electroacoustic transducer is called a piezoelectric speaker.

Further, an electroacoustic transducer of an electrostatic type takes advantage of the fact that an electrostatic field is formed when a DC voltage is applied between an electrically conductive diaphragm and a fixed plate that are brought close to each other. If an alternating current that is an acoustic signal is applied in this situation, the attractive force of the electrostatic field changes due to the voltage change, and the diaphragm moves. Such an electroacoustic transducer is called an electrostatic (capacitor) speaker.

Meanwhile, resistance indicates the degree of difficulty for electricity to flow. If the resistance is high, electric current hardly flows even when the same voltage is applied. The resistance often depends on the frequency of an AC voltage, and the resistance at each frequency is called impedance.

In the meantime, a dynamic speaker requires a magnetic circuit system such as a magnet as a component. Therefore, the unit thickness and the unit weight of the dynamic speaker exceed certain levels.

For example, in a case where the speaker is carried around as a portable device, or where the speaker is attached to a wall surface and is then used, thinness and lightness are critical for the speaker to be commercialized. Further, in a case where the speaker is used as an in-vehicle device in a private vehicle or the like, thinness and lightness of the speaker are also critical in commercialization.

Here, a piezoelectric speaker and an electrostatic speaker have the advantage that both speakers are lighter than a dynamic speaker, requiring no magnetic circuit systems. However, there is a tendency that it is difficult for a piezoelectric speaker and an electrostatic speaker to secure sound pressure in low frequency ranges.

To counter this, a method of increasing the speaker area has been suggested as a method for increasing sound pressure in low frequency ranges. However, if the speaker area is increased, manufacturing becomes difficult due to the increase in size, and further, freedom in installation is lost.

On the other hand, a piezoelectric speaker and an electrostatic speaker have capacitive impedance. In other words, a piezoelectric speaker and an electrostatic speaker have such characteristics that the impedance is high in low frequency ranges and is low in high frequency ranges, unlike the characteristics of a dynamic speaker whose impedance stays within the range of 4 to 16 ohms in all frequency ranges.

For example, in a case where a plurality of speakers are driven, the impedance becomes even lower if the speakers are connected in parallel, and, in a dynamic speaker, the impedance in the audio band might become too low. In such a case, if the impedance of the speakers is lower than the output impedance of the amplifier, the current output to be supplied to the speakers is restricted, and the performance of the speakers and the amplifier is degraded.

Meanwhile, in the trend of a wider variety of uses of speakers, there is a method of increasing the effects of advertising by giving directivity to the sound to be output outdoors for digital signage.

In addition, as for personal use, directivity is given so that persons do not bother each other in a case where a plurality of persons in the same house listen to different sounds at the same time, directivity is given in a navigation system that is to give warnings only to the driver in a vehicle, or the like, for example.

In such cases, if the volume of sound is simply increased, the sound becomes nothing more than noise for the others, and it cannot be said that a preferred audio environment is successfully provided.

In view of this, techniques for realizing sound reproduction having directivity have been suggested.

For example, a parametric speaker specialized in directivity has been suggested as such a technique (see Patent Document 1, for example). With this technique, a plurality of ultrasonic transducers are provided to improve the directivity characteristics of ultrasonic waves. In addition, as for the material of ultrasonic transducer speakers, a piezoelectric material or an electrostatic material is used, and a plurality of ultrasonic transducer speakers are connected in parallel.

Further, a speaker system has also been suggested as a technique for realizing sound reproduction having directivity. In the speaker system, a plurality of dynamic speakers are used, and the dynamic speakers are disposed linearly and densely, to improve directivity characteristics (see Patent Document 2, for example).

CITATION LIST

Patent Documents

Patent Document 1: Japanese Patent Application Laid-Open No. 2011-234248

Patent Document 2: Japanese Patent Application Laid-Open No. 2006-304128

SUMMARY OF THE INVENTION

Problems to be Solved by the Invention

However, with the above described techniques, it is difficult to realize sound reproduction with high sound quality and excellent directivity characteristics at lower costs.

For example, the parametric speaker disclosed in Patent Document 1 cannot perform sound reproduction with high sound quality. Therefore, this technique cannot be considered suitable for audio usage. That is, the parametric speaker can be used only for limited purposes.

Also, with the technique disclosed in Patent Document 2, the number of amplifiers required for each channel is large, resulting in higher costs. That is, according to the technique disclosed in Patent Document 2, it is necessary to provide amplifiers for the respective dynamic speakers that are linearly arranged.

The present technology has been made in view of such circumstances, and aims to realize sound reproduction with higher sound quality and excellent directivity characteristics at lower costs.

Solutions to Problems

A sound reproducing apparatus according to a first aspect of the present technology includes: an amplification unit that amplifies an acoustic signal; a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit.

The sound reproducing apparatus may further include an instruction unit that outputs instruction information for controlling directivity, and the switching unit may switch connections of the electroacoustic transducers in accordance with the instruction information.

The switching unit may connect a plurality of the electroacoustic transducers in parallel to the amplification unit.

The sound reproducing apparatus may further include a signal processing unit that performs signal processing on the acoustic signal, in accordance with the instruction information.

In accordance with the instruction information, the signal processing unit may perform the signal processing depending on the characteristics, the number, or the positions of the electroacoustic transducers connected to the amplification unit by the switching unit.

In accordance with the instruction information, the signal processing unit may further perform a protection process to protect the electroacoustic transducers connected to the amplification unit by the switching unit.

The signal processing unit may perform a process of attenuating a component of the acoustic signal as the protection process, the component being not lower than a predetermined frequency.

The sound reproducing apparatus may further include an electroacoustic transduction unit formed with a plurality of subunits overlapped on one another, each of the subunits being formed with a plurality of the electroacoustic transducers aligned. The switching unit may switch the connections of the electroacoustic transduction unit so that one or a plurality of electroacoustic transducers among the electroacoustic transducers constituting the electroacoustic transduction unit are connected to the amplification unit.

The sound reproducing apparatus may further include a detection unit that detects a user near the sound reproducing apparatus, and the instruction unit outputs the instruction information corresponding to a result of the detection performed by the detection unit.

A sound reproduction method or a program according to the first aspect of the present technology is a sound reproduction method implemented or a program executed in a sound reproducing apparatus that includes: an amplification unit that amplifies an acoustic signal; a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit. The sound reproduction method or the program includes steps of: the amplification unit amplifying the acoustic signal; the switching unit switching connections of the electroacoustic transducers; and the electroacoustic transducers outputting sound in accordance with the acoustic signal.

According to the first aspect of the present technology, a sound reproducing apparatus includes: an amplification unit that amplifies an acoustic signal; and a plurality of electroacoustic transducers that output sound in accordance with the acoustic signal output from the amplification unit, the electroacoustic transducers having characteristics of a capacitive load. In the sound reproducing apparatus, the connections of the electroacoustic transducers to the amplification unit are switched so that one or a plurality of electroacoustic transducers among the plurality of electroacoustic transducers are connected to the amplification unit.

A sound reproducing apparatus according to a second aspect of the present technology, a sound reproducing apparatus includes: an amplification unit that amplifies an acoustic signal; an electroacoustic transduction unit that has characteristics of a capacitive load, and outputs sound in accordance with the acoustic signal output from the amplification unit; and a movable unit that moves the electroacoustic transduction unit.

The sound reproducing apparatus may further include an instruction unit that outputs instruction information for controlling directivity, and the movable unit may move the electroacoustic transduction unit in accordance with the instruction information.

The electroacoustic transduction unit may be movable at least in a first direction and a second direction that are perpendicular to each other.

The electroacoustic transduction unit may be disposed to hide part of or all the electroacoustic transduction unit behind a shielding member when viewed from a predetermined direction, and the movable unit may change the relative position of the electroacoustic transduction unit with respect to the shielding member.

The electroacoustic transduction unit may include a plurality of electroacoustic transducers that output sound in accordance with the acoustic signal output from the amplification unit, the electroacoustic transducers having characteristics of a capacitive load. The sound reproducing apparatus may further include a switching unit that switches the connections of the electroacoustic transducers to the amplification unit so that one or a plurality of electroacoustic transducers among the plurality of electroacoustic transducers are connected to the amplification unit.

The electroacoustic transduction unit may be formed with a plurality of subunits overlapped on one another, each of the subunits being formed with a plurality of the electroacoustic transducers aligned.

The sound reproducing apparatus may further include a detection unit that detects a user near the sound reproducing apparatus, and the instruction unit outputs the instruction information corresponding to a result of the detection performed by the detection unit.

The sound reproducing apparatus may further include a signal processing unit that performs signal processing on the acoustic signal, in accordance with the instruction information.

A sound reproduction method or a program according to the second aspect of the present technology is a sound reproduction method implemented or a program executed in a sound reproducing apparatus that includes: an amplification unit that amplifies an acoustic signal; an electroacoustic transduction unit that has characteristics of a capacitive load and outputs sound in accordance with the acoustic signal output from the amplification unit; and a movable unit that moves the electroacoustic transduction unit. The sound reproduction method or the program includes steps of: the amplification unit amplifying the acoustic signal; the movable unit moving the electroacoustic transduction unit; and the electroacoustic transduction unit outputting sound in accordance with the acoustic signal.

According to the second aspect of the present technology, a sound reproducing apparatus includes: an amplification unit that amplifies an acoustic signal; and an electroacoustic transduction unit that has characteristics of a capacitive load, and outputs sound in accordance with the acoustic signal output from the amplification unit. In the sound reproducing apparatus, the electroacoustic transduction unit is moved by a movable unit.

Effects of the Invention

According to the first and second aspects of the present technology, it is possible to realize sound reproduction with higher sound quality and excellent directivity characteristics at lower costs.

It should be noted that the effects of the present technology are not limited to the effects described herein, and may include any of the effects described in the present disclosure.

MODE FOR CARRYING OUT THE INVENTION

The following is a description of embodiments to which the present technology is applied, with reference to the drawings.

First Embodiment

Example Configuration of a Sound Reproducing Apparatus

The present technology aims to realize sound reproduction with high sound quality and excellent directivity characteristics at lower costs, by connecting a plurality of speakers having the characteristics of a capacitive load, and switching one or a plurality of speakers to be the supply destinations of an acoustic signal of one channel as appropriate. As a result, users can receive services relating to sound reproduction in a preferred manner.

Figure 1:
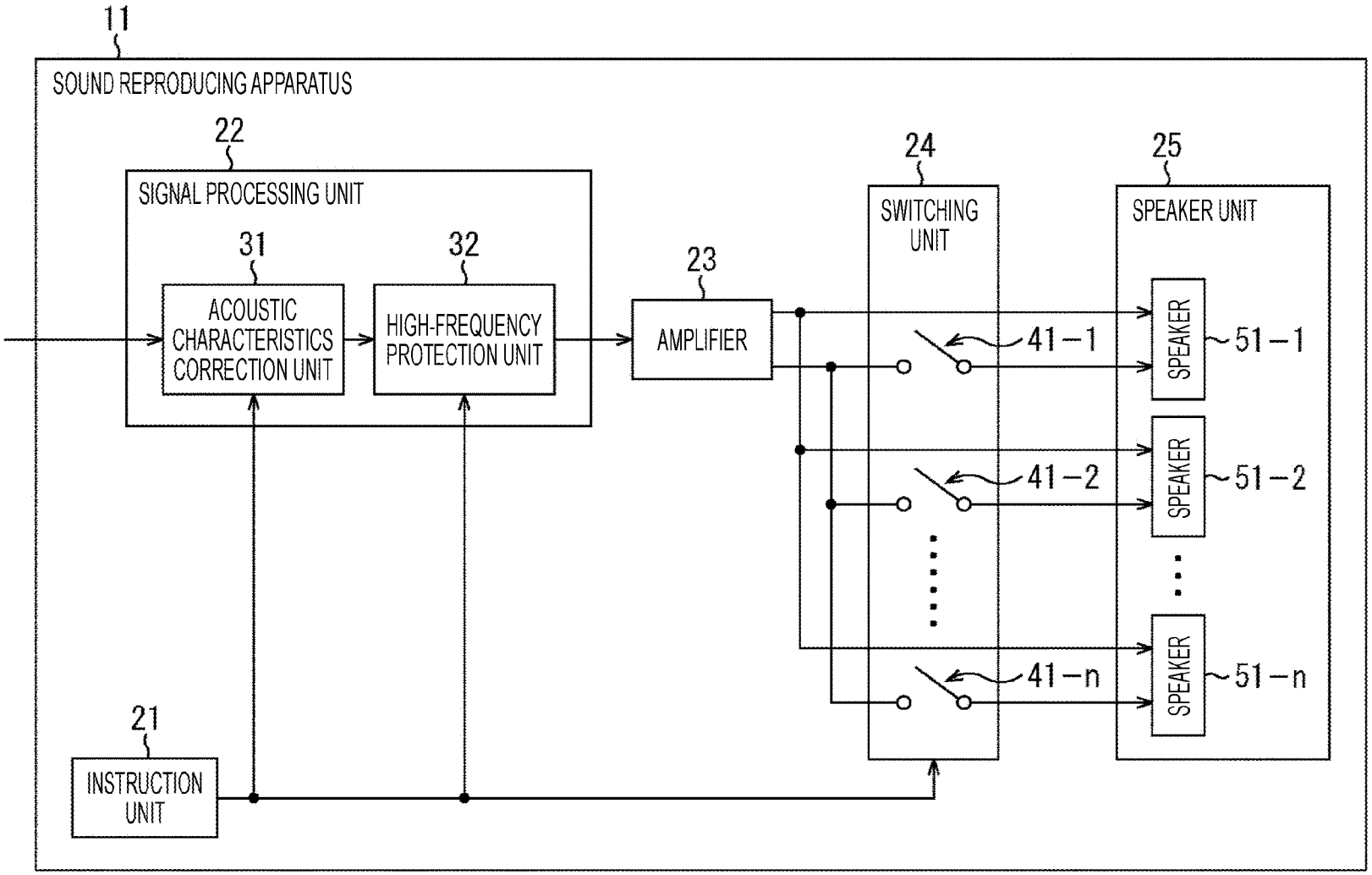
FIG. 1 is a diagram showing an example configuration of a sound reproducing apparatus.

FIG. 1 is a diagram showing an example configuration of an embodiment of a sound reproducing apparatus to which the present technology is applied.

The sound reproducing apparatus 11 shown in FIG. 1 includes an instruction unit 21, a signal processing unit 22, an amplifier 23, a switching unit 24, and a speaker unit 25.

The instruction unit 21 supplies the signal processing unit 22 and the switching unit 24 with instruction information for controlling the directivity and the like of the sound to be reproduced by the speaker unit 25. Note that the instruction information may be generated by the instruction unit 21, or may be acquired from the outside by the instruction unit 21.

The acoustic signal of one channel is supplied from the outside to the signal processing unit 22. Here, the acoustic signal to be supplied to the signal processing unit 22 is a signal for reproducing sound such as a tune, human voice, or the sound of content, for example.

In accordance with the instruction information supplied from the instruction unit 21, the signal processing unit 22 performs various kinds of signal processing on the externally supplied acoustic signal, and supplies the acoustic signal subjected to the signal processing to the amplifier 23.

The signal processing unit 22 includes an acoustic characteristics correction unit 31 and a high-frequency protection unit 32.

In accordance with the instruction information supplied from the instruction unit 21, the acoustic characteristics correction unit 31 performs an acoustic characteristics correction process on the externally supplied acoustic signal, and supplies the acoustic signal to the high-frequency protection unit 32. In accordance with the instruction information supplied from the instruction unit 21, the high-frequency protection unit 32 performs a high-frequency protection process for protecting the speaker unit 25 and the amplifier 23, on the acoustic signal supplied from the acoustic characteristics correction unit 31, and supplies the acoustic signal to the amplifier 23.

In the signal processing unit 22, the acoustic characteristics correction process by the acoustic characteristics correction unit 31 and the high-frequency protection process by the high-frequency protection unit 32 are performed as signal processing on the acoustic signal.

The amplifier 23 amplifies the acoustic signal supplied from the high-frequency protection unit 32, and supplies the amplified signal to the switching unit 24. The switching unit 24 switches output destinations of the acoustic signal supplied from the amplifier 23, in accordance with the instruction information supplied from the instruction unit 21.

Specifically, the switching unit 24 includes n switches 41-1 through **41-*n*. The switching unit 24 switches on or off the switches 41-1 through 41-*n*** in accordance with the instruction information, to switch output destinations of the acoustic signal.

The speaker unit 25 is an electroacoustic transduction unit that is formed with n (n≥2) speakers 51-1 through **51-*n* arranged in a predetermined layout, and performs sound reproduction in accordance with the acoustic signal supplied from the switching unit 24**.

In the speaker unit 25, each of the speakers 51-1 through **51-*n* is connected to the amplifier 23 via each corresponding one of the switches 41-1 through 41-*n***.

Note that in the description below, the switches 41-1 through **41-*n* will be also referred to simply as the switches 41 unless it is necessary to specifically distinguish the switches 41-1 through 41-*n* from one another, and the speakers 51-1 through 51-*n* will be also referred to simply as the speakers 51 unless it is necessary to specifically distinguish the speakers 51-1 through 51-*n*** from one another.

In the following, the respective components of the sound reproducing apparatus 11 are described in greater detail.

Each speaker 51 is an electroacoustic transducer with capacitive load characteristics, such as an electrostatic speaker or a piezoelectric speaker, which is a speaker having a capacitive impedance, for example.

Each speaker 51 having such capacitive load characteristics can perform sound reproduction with high sound quality. However, if the area of the speaker 51, or more specifically, the area of the diaphragm portion of the speaker 51 is small, it might be difficult for the speaker 51 to secure a sufficient low-frequency sound pressure.

The n speakers 51 constituting the speaker unit 25 are arranged in an appropriate layout, such as a matrix form or a linear shape, for example.

Note that a plurality of speakers 51 arranged in a plane may be set as a subunit, and a plurality of subunits arranged in a direction perpendicular to the plane in an overlapping manner may be set as the speaker unit 25, to secure a sufficient low-frequency sound pressure at a time of sound reproduction. In this case, as a plurality of subunits are arranged in an overlapping manner, low-frequency sound pressure can be secured without any increase in the area of the speaker unit 25.

In the sound reproducing apparatus 11, a plurality of speakers 51 are provided for each channel, and which speaker 51 among the n speakers 51 is to receive an acoustic signal, or which speaker 51 is to be used for sound reproduction, depends on the connection states of the respective switches 41.

In this example, a plurality of speakers 51 are connected to the single amplifier 23 via the switches 41.

For example, when a switch 41 is turned on, or when a switch 41 is put into a connected state, the speaker 51 connected to the switch 41 and the amplifier 23 are electrically connected to each other, and the acoustic signal output from the amplifier 23 is supplied to the speaker 51 via the switch 41.

On the other hand, when a switch 41 is turned off, or when a switch 41 is put into an open state (a disconnected state), the speaker 51 connected to the switch 41 and the amplifier 23 are electrically disconnected from each other, and the acoustic signal output from the amplifier 23 is not supplied to the speaker 51.

By controlling the connection states of the n switches 41 in accordance with the instruction information, the switching unit 24 can connect a plurality of speakers 51 in parallel to the single amplifier 23, or connect only one speaker 51 to the single amplifier 23. In this manner, the switching unit 24 controls the switches 41 so that one or more speakers 51 of the n speakers 51 constituting the speaker unit 25 are electrically connected to the amplifier 23, and thus switches connections of the respective speakers 51 to the amplifier 23.

Note that, although a case where all the n speakers 51 are connected to the single amplifier 23 has been described herein, it is also possible to provide a plurality of amplifiers in the sound reproducing apparatus 11 so that some of the n speakers can be connected in parallel to each of the amplifiers.

Specifically, the amplifier 23 and other amplifiers may be connected in parallel to the high-frequency protection unit 32, and m (n>m) speakers 51 may be connected to the amplifier 23 via the switching unit 24 while the remaining (n−m) speakers 51 are connected to the other amplifiers via the switching unit 24, for example.

Further, although the switching unit 24 connects the speakers 51 to the amplifier 23 with the switches 41, or disconnects the speakers 51 to the amplifier 23 with the switches 41 in the example described herein, the switching unit 24 may have any configuration, as long as desired characteristics can be achieved.

In addition to that, the switching unit 24 may be formed with an attenuation circuit capable of attenuating an acoustic signal, a circuit capable of changing the phase of an acoustic signal, and the like, for example. Specifically, in a case where the switching unit 24 is provided with an attenuation circuit, the attenuation circuit appropriately attenuates an acoustic signal so that the connection between the amplifier 23 and the speakers 51 connected to the attenuation circuit can be substantially put into an unconnected state.

Further, the instruction information output by the instruction unit 21 may be information for controlling the directivity of the sound to be reproduced by the speaker unit 25, or the like, for example.

Specifically, the instruction information may be information for restricting the directivity of the sound to be reproduced by the speaker unit 25 to a specific direction such as a horizontal direction, a vertical direction, or an oblique direction, for example. In this case, with the instruction information, it is possible to change not only the direction to which the directivity is restricted, or the direction in which directivity is to be given, but also the strength of the directivity.

In a case where the directivity at a time of sound reproduction is controlled with the instruction information in this manner, the switching unit 24 selects the speaker 51 to be used for the sound reproduction in accordance with the instruction information, and changes the connection states of the switches 41 in accordance with the selection result.

In the example case described below, a plurality of speakers 51 are linearly arranged, and sound reproduction is performed with only the speakers 51 arranged adjacent to one another among the speakers 51, for example.

It is known that, if the number of the speakers 51 to be used for sound reproduction is increased in this case, or if the length of the speaker array formed with the speakers 51 that reproduce sound is increased in this case, the directivity of the sound in the direction of the speaker array, or in the direction in which the speakers 51 are aligned, becomes higher.

Therefore, the switching unit 24 selects the speakers 51 to be used for reproduction, in accordance with the direction in which directivity is to be given and the strength of the directivity in that direction as indicated by the instruction information supplied from the instruction unit 21. The switching unit 24 then electrically connects only the selected speakers 51 to the amplifier 23. As a result, sound reproduction can be performed with desired directivity characteristics. In other words, sound reproduction with excellent directivity characteristics can be realized.

Note that, hereinafter, the length in a predetermined direction of a speaker group formed with one speaker 51 or a plurality of speakers 51 arranged adjacent to one another will be also referred to as a speaker length in that direction.

As described above, when being instructed to give directivity in a predetermined direction through the instruction information, the switching unit 24 selects the speakers 51 to be used for sound reproduction so that the speaker length in the direction in which directivity is to be given becomes long, and controls the connection states of the switches 41 in accordance with the selection result.

Alternatively, the instruction information may be information for increasing or decreasing the sound pressure of the sound in the reproduction space, information designating the position of output of the sound or the positions of the speakers 51 to be made to output the sound, information designating the region to be the output destination of the sound in the reproduction space, or the like, for example.

In this case, the switching unit 24 selects the speakers 51 to be used for sound reproduction in accordance with the instruction information, for example, and changes the connection states of the switches 41 in accordance with the selection result.

Specifically, in a case where instruction information for increasing sound pressure is supplied, for example, the switching unit 24 selects the speakers 51 to be used for sound reproduction so that the largest possible number of speakers 51 will be used for sound reproduction. Alternatively, in a case where instruction information for outputting sound to a specific region in the reproduction space is supplied, for example, the switching unit 24 selects a necessary number of speakers 51 located close to the specific region or speakers 51 directed toward the specific region, and controls the connection states of the switches 41 so that sound will be output from the selected speakers 51.

Through such control, the sound pressure at a desired position in the reproduction space can be set as a target sound pressure, sound can be output from the speaker(s) 51 located at a predetermined height, or sound can be output to a specific region in the reproduction space, for example.

Further, the instruction information may be information for controlling distant audibility, which is the straightness of the sound to be reproduced, or for controlling the frequency characteristics of the sound to be reproduced, such as high frequency emphasis. Also in this case, the switching unit 24 selects the speakers 51 to be used for sound reproduction in accordance with the instruction information, and changes the connection states of the switches 41 in accordance with the selection result. Thus, desired straightness or desired frequency characteristics can be achieved.

Note that the instruction information may of course be information indicating combinations of directivity control, sound pressure control, sound output position control, sound straightness control, frequency characteristics control, and the like.

In accordance with the instruction information supplied from the instruction unit 21, the acoustic characteristics correction unit 31 also performs a process of correcting the acoustic characteristics of the acoustic signal so that preferable sound quality for the purpose indicated by the instruction information can be achieved.

Specifically, in a case where information for giving directivity in a predetermined direction is output as the instruction information from the instruction unit 21, for example, the switching unit 24 selects the speakers 51 according to the instruction information as the speakers 51 to be used for sound reproduction.

In this case, the acoustic characteristics correction unit 31 performs a waveform equalization process on the acoustic signal, using a filter coefficient determined beforehand in accordance with the characteristics of the respective speakers 51 to be used for sound reproduction, and the number and the positions of the speakers 51 to be used for sound reproduction. That is, a filtering process using a filter coefficient is performed, so that waveform equalization is performed as a process for correcting acoustic characteristics.

Here, in the acoustic characteristics correction unit 31, the filter coefficient to be used is determined beforehand for the values in the instruction information or the like, for example. In addition, the filter coefficient is the optimum coefficient for the characteristics, the number, and the positions of the speakers 51 to be used for sound reproduction, which are determined by the instruction information.

That is, the frequency characteristics, the phase, and the sound pressure of the sound to be reproduced vary depending on the characteristics, the number, and the positions of the speakers 51 to be used for sound reproduction, for example. Therefore, in the acoustic characteristics correction unit 31, an appropriate filter coefficient is selected in accordance with the instruction information so that the frequency characteristics, the phase, the sound pressure, and the like are appropriately corrected, and a waveform equalization process is then performed with the use of the filter coefficient.

Note that the acoustic characteristics correction unit 31 only needs to be able to obtain sound with appropriate sound quality for the purpose indicated by the instruction information. For example, in the acoustic characteristics correction unit 31, a filtering process may be performed on the acoustic signal so as to give inverse characteristics to the frequency characteristics determined by the characteristics, the number, and the positions of the speakers 51 to be used for sound reproduction, and amplitude characteristics and phase characteristics may be corrected.

Also, in the acoustic characteristics correction unit 31, each frequency component of the acoustic signal may be corrected so that the human voice is emphasized for easier hearing, for example. In other words, the acoustic characteristics correction unit 31 may perform correction to give frequency characteristics that make a navigation voice or the like easier to hear.

Further, in the sound reproducing apparatus 11, a plurality of speakers 51 can be connected in parallel to one amplifier 23 for each channel of acoustic signals.

In a case where a plurality of speakers 51 are driven, the impedance in the audio band of the speakers 51 having the characteristic of a capacitive load is sufficiently greater than that in a high frequency band. Accordingly, a larger number of speakers 51 than dynamic speakers can be connected in parallel.

Therefore, to secure a sufficient low-frequency sound pressure, the speaker area, which is the total area of the diaphragm portions of the speaker group formed with a plurality of speakers 51, is increased. With such arrangement, the plurality of speaker 51 having a size for which manufacturing and attachment are taken into consideration can be connected in parallel and be driven.

Since the speakers 51 each have the characteristic of a capacitive load, a sufficiently high impedance is substantially secured in the audio band of one speaker 51 of the speaker unit 25. In addition to that, the speakers 51 are connected in parallel to the amplifier 23, and therefore, the impedance of the speakers 51 decreases. However, it is still possible to secure a sufficiently high impedance as required.

The impedance of these speakers 51 and the impedance to be secured vary depending on factors such as the number and the area of the plurality of mounted speakers 51, the required sound pressure, and the directivity characteristics, in addition to the differences of the amplifier 23 and the speakers 51.

Note that, even if amplifiers are provided for the respective speakers 51 as in the configuration of a conventional dynamic speaker, the sound reproducing apparatus 11 can still perform sound reproduction with high sound quality and excellent directivity characteristics.

Further, in addition to the acoustic characteristics correction unit 31, the high-frequency protection unit 32 for protecting the speaker unit 25 and the amplifier 23 is provided in the signal processing unit 22.

For example, in a case where a plurality of speakers 51 having the characteristics of a capacitive load are driven to increase the sound pressure at a time of sound reproduction, the load on the amplifier 23 becomes smaller. At this stage, if the impedance of the speakers 51 is lower than the output impedance of the amplifier 23 at high frequency, the current output to be supplied to the speakers 51 is restricted, and the performance of the speaker 51 is degraded.

For example, in a case where information for giving directivity in a specific direction or changing sound pressure is output as the instruction information from the instruction unit 21, the speakers 51 to be used for sound reproduction are selected in accordance with the instruction information, and are electrically connected to the amplifier 23.

At this stage, the high-frequency protection unit 32 performs a high-frequency protection process for appropriately protecting the speaker 51 and the amplifier 23, in accordance with the number of the speakers 51 to be used for sound reproduction and the characteristics and the like of the speakers 51.

Specifically, the high-frequency protection unit 32 may be formed with a low-pass filter or a band-pass filter that cuts off the high frequency range of an acoustic signal, for example. The high-frequency protection unit 32 can protect the speakers 51 and the amplifier 23 by attenuating the ultrahigh-frequency components such as components over 20 kHz in the acoustic signal.

Note that, in the example described herein, the high-frequency protection unit 32 is formed with a filter such as a low-pass filter or a band-pass filter, and the high-frequency protection unit 32 performs a filtering process on an acoustic signal. However, the high-frequency protection unit 32 may be formed with some other structure, such as a protection resistor added (connected) in series between the speakers 51 and the amplifier 23. In such a case, a 4-ohm resistor is provided as the high-frequency protection unit 32, for example, so that the minimum impedance can be guaranteed, though there is power loss and heat generation.

In addition to the above, the speakers 51 have the characteristic of a capacitive load. Therefore, the amplifier 23 preferably has a high output voltage, and is preferably capable of applying a large current.

Further, the sound reproducing apparatus 11 has a configuration for reproducing an acoustic signal of one channel in the example case described with reference to FIG. 1, but may have a configuration for reproducing an acoustic signal of a plurality of channels. In such a case, the same number of sets of the instruction unit 21 through the speaker unit 25 as the number of the channels to be reproduced are provided in the sound reproducing apparatus 11, for example.

Description of a Sound Reproduction Process

Next, operation of the sound reproducing apparatus 11 is described. Specifically, referring now to the flowchart in FIG. 2, a sound reproduction process to be performed by the sound reproducing apparatus 11 is described below.

In step S11, the instruction unit 21 generates instruction information or acquires instruction information as appropriate, and outputs the acquired instruction information to the acoustic characteristics correction unit 31, the high-frequency protection unit 32, and the switching unit 24.

Here, as described above, the instruction information may be information for controlling the direction in which directivity is to be given and the intensity of the directivity, information for controlling sound pressure, information for controlling the output position of sound, information designating the region to be the output destination of sound in the reproduction space, information for controlling frequency characteristics, and the like, for example.

In step S12, the acoustic characteristics correction unit 31 performs signal processing on an acoustic signal supplied from the outside, in accordance with the instruction information supplied from the instruction unit 21.

Specifically, the acoustic characteristics correction unit 31 selects a filter coefficient in accordance with the characteristics, the number, and the positions of the speakers 51 that are selected by the switching unit 24 in accordance with the instruction information and are to be used for sound reproduction. The acoustic characteristics correction unit 31 then performs a filtering process on the acoustic signal, using the selected filter coefficient. By doing so, the acoustic characteristics correction unit 31 performs processing such as waveform equalization on the acoustic signal, and supplies the resultant acoustic signal to the high-frequency protection unit 32.

In step S13, the high-frequency protection unit 32 performs a high-frequency protection process on the acoustic signal supplied from the acoustic characteristics correction unit 31, and supplies the resultant acoustic signal to the amplifier 23.

For example, the high-frequency protection unit 32 selects a filter coefficient in accordance with the characteristics, the number, and the positions of the speakers 51 that are selected by the switching unit 24 in accordance with the instruction information and are to be used for sound reproduction. The high-frequency protection unit 32 then performs a filtering process on the acoustic signal with the selected filter coefficient, to attenuate components equal to or higher than a predetermined frequency in the high frequency range of the acoustic signal.

In step S14, the amplifier 23 amplifies the acoustic signal supplied from the high-frequency protection unit 32, and supplies the amplified acoustic signal to the switching unit 24.

In step S15, the switching unit 24 selects the speakers 51 to be used for sound reproduction in accordance with the instruction information supplied from the instruction unit 21, and switches connections between the respective speakers 51 and the amplifier 23 in accordance with the selection result.

Specifically, the switching unit 24 selects the speakers 51 to be used for sound reproduction, in accordance with the purpose indicated by the instruction information. The switching unit 24 then electrically connects the selected speakers 51 to the amplifier 23 by turning on the switches 41 connected to the selected speakers 51, and also electrically disconnects the unselected speakers 51 from the amplifier 23 by turning off the switches 41 connected to the unselected speakers 51.

As a result, only the speakers 51 to be used for sound reproduction are connected in parallel to the amplifier 23, and the acoustic signal output from the amplifier 23 is supplied to the speakers 51 to be used for sound reproduction via the switches 41 that have been turned on. As the speakers 51 unnecessary for sound reproduction are electrically disconnected from the amplifier 23 in this manner, it is possible to prevent the impedance of the parallel-connected speakers 51 from becoming lower than necessary.

Note that the processing in step S15 may be performed at any timing after the processing in step S11 is performed and before the processing in step S16 is performed.

In step S16, the speakers 51 reproduce sound in accordance with the acoustic signal supplied from the amplifier 23, and the sound reproduction process then comes to an end.

Specifically, each speaker 51 to which the acoustic signal is supplied outputs sound waves in accordance with the supplied acoustic signal, to realize sound reproduction with desired directivity characteristics, frequency characteristics, and the like. Thus, the listener (user) can listen to excellent sound suitable for the purpose.

As described above, the sound reproducing apparatus 11 selects the speakers 51 to be used for sound reproduction in accordance with instruction information, and performs sound reproduction by connecting only the selected speakers 51 in parallel to the amplifier 23.

By virtue of this configuration, it is possible to realize sound reproduction with high sound quality and excellent directivity characteristics at low costs, using the speakers 51 having the characteristics of a capacitive load. Particularly, in the sound reproducing apparatus 11, it is possible to easily achieve desired directivity characteristics by selectively using one or a plurality of speakers 51 for sound reproduction. That is, directivity can be controlled in a preferred manner.

It is also possible to selectively connect a plurality of speakers 51 in parallel. Accordingly, sufficient sound pressure in a low frequency range can be secured even if relatively small speakers are used as the respective speakers 51. Thus, it is possible to realize sound reproduction with high sound quality at low costs. In other words, where relatively small speakers 51 are used, it is possible not only to lower the manufacturing costs of the speakers 51 and increasing the yield, but also to increase the degree of freedom in arranging and mounting the speakers 51 and the like.

Further, in the sound reproducing apparatus 11, a plurality of speakers 51 can be selectively connected in parallel to the amplifier 23. Accordingly, there is no need to prepare a plurality of amplifiers 23, and cost reduction can be realized.

Specific Example Application of the Present Technology

Next, a more specific example application of the above described present technology is described.

Figure 3:
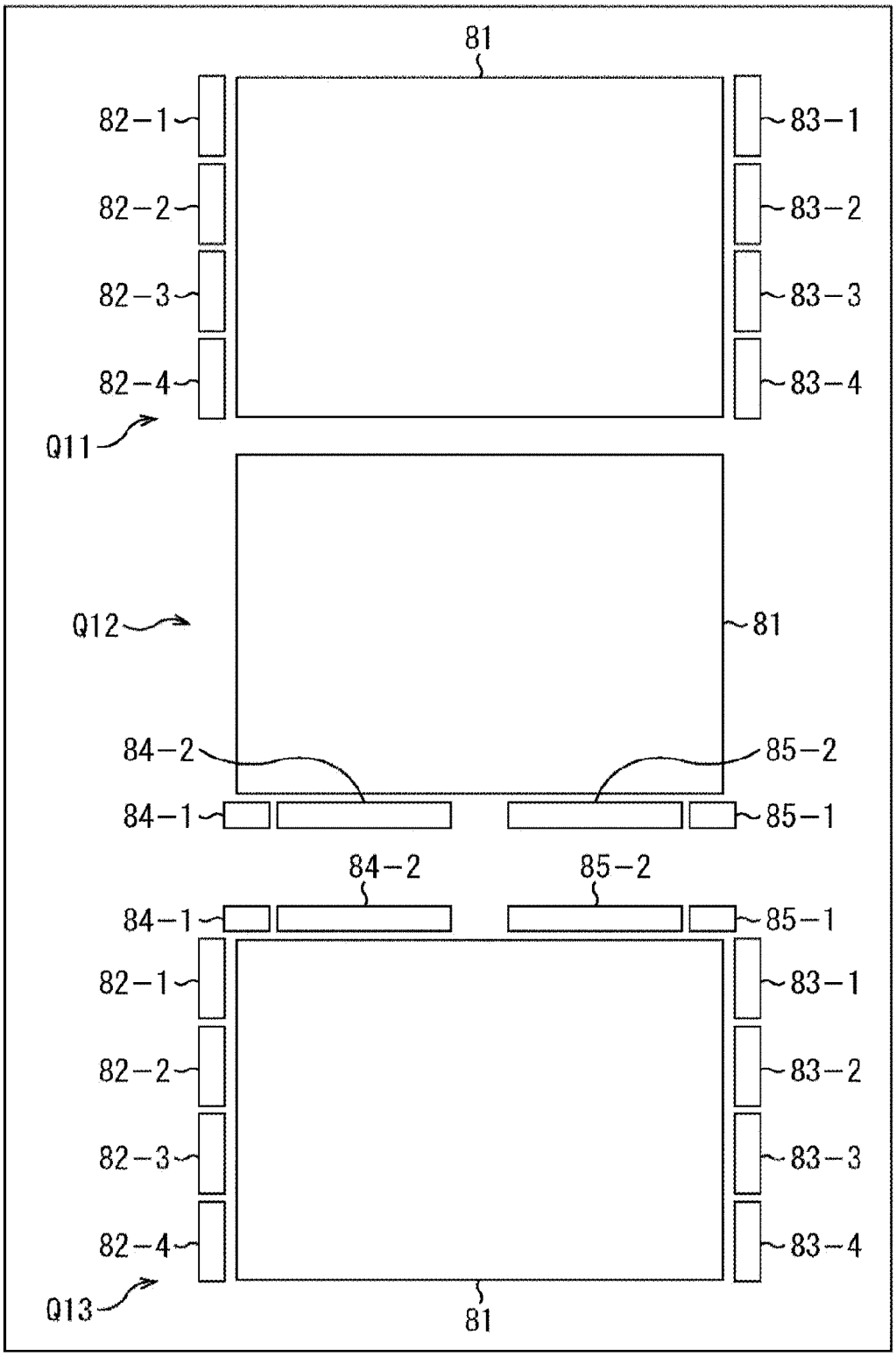
FIG. 3 is a diagram showing an example application of the present technology to a display.

FIG. 3 is a diagram for explaining a case where the present technology is applied to a display having a sound reproduction function, for example. Note that the blocks corresponding to the instruction unit 21 through the switching unit 24 shown in FIG. 1 are not shown in each of the examples shown in FIG. 3.

For example, in the example indicated by an arrow Q11, a display to which the present technology is applied includes a display unit 81 that displays an image, and speakers 82-1 through 82-4 and speakers 83-1 through 83-4 disposed at both ends of the display unit 81.

In this example, the speakers 82-1 through 82-4 that are long in the vertical direction in the drawing are arranged in the vertical direction along the left edge of the display unit 81 in the drawing. Hereinafter, where there is no particular need to distinguish the speakers 82-1 through 82-4 from one another, the speakers 82-1 through 82-4 will be also referred to simply as the speakers 82. For example, an acoustic signal of a left channel is supplied to the speakers 82.

These speakers 82 correspond to the speakers 51 shown in FIG. 1, and a unit formed with the four speakers 82 corresponds to the speaker unit 25 in FIG. 1.

Therefore, one amplifier is connected to the speakers 82-1 through 82-4 via a switching unit, for example, and the connection states of the switches of the switching unit are controlled so that any appropriate speakers 82 can be connected in parallel to the amplifier.

Likewise, the speakers 83-1 through 83-4 that are long in the vertical direction in the drawing are arranged in the vertical direction along the right edge of the display unit 81 in the drawing. Hereinafter, where there is no particular need to distinguish the speakers 83-1 through 83-4 from one another, the speakers 83-1 through 83-4 will be also referred to simply as the speakers 83. For example, an acoustic signal of a right channel is supplied to the speakers 83.

These speakers 83 correspond to the speakers 51 shown in FIG. 1, and a unit formed with the four speakers 83 corresponds to the speaker unit 25 in FIG. 1.

Therefore, one amplifier is connected to the speakers 83-1 through 83-4 via a switching unit, for example, and the connection states of the switches of the switching unit are controlled so that any appropriate speakers 83 can be connected in parallel to the amplifier.

In a case where sound reproduction is performed in accordance with a left channel acoustic signal in such a display, for example, it is possible to control the directivity of the sound to be output, by changing the speaker(s) 82 to be used among the four speakers 82.

For example, the region of the diaphragms of the speaker group formed with the four speakers 82, or the region formed by aligning the respective diaphragms of the four speakers 82, is a rectangular region that is long in the vertical direction in the drawing in this example. Hereinafter, such a region of the diaphragms of a speaker group will be also referred to as the speaker unit region.

It is generally known that the directivity of sound output from a speaker unit is high in the direction in which the speaker unit region is long, and is low in the direction in which the speaker unit region is short. That is, there is a tendency for sound to spread in the direction in which the speaker unit region is short.

Therefore, in a case where sound reproduction is performed with all the four speakers 82, for example, sound that has a high directivity in the vertical direction in the drawing and is to spread in the horizontal direction in the drawing is output.

Also, in a case where sound reproduction is performed with all the four speakers 82, it is possible to output sound having a higher directivity in the vertical direction than in a case where sound reproduction is performed with only one or two speakers 82. The same also applies to sound reproduction using the speakers 83.

Accordingly, in the example indicated by the arrow Q11, it is possible to appropriately control the directivity in the vertical direction in the drawing by appropriately selecting the speakers 82 and the speakers 83 to be used for sound reproduction.

Meanwhile, in the example indicated by an arrow Q12, a speaker 84-1 and a speaker 84-2, and a speaker 85-1 and a speaker 85-2 are provided on the lower left side and the lower right side, respectively, of the display unit 81 in the drawing.

Specifically, the speaker 84-1 and the speaker 84-2, which are long in the lateral direction in the drawing, are arranged in the lateral direction at a lower left portion of the display unit 81 in the drawing, along the lower edge of the display unit 81. Hereinafter, where there is no particular need to distinguish the speakers 84-1 and 84-2 from each other, the speakers 84-1 and 84-2 will be also referred to simply as the speakers 84.

In this example, the speaker 84-2 is longer than the speaker 84-1 in the lateral direction in the drawing, and these two speakers 84 constitute a speaker unit. Accordingly, the speaker 84-1 and the speaker 84-2 can be connected in parallel to one amplifier, and an acoustic signal of a left channel is supplied to these speakers 84, for example.

Likewise, the speaker 85-1 and the speaker 85-2, which are long in the lateral direction in the drawing, are arranged in the lateral direction at a lower right portion of the display unit 81 in the drawing, along the lower edge of the display unit 81. Hereinafter, where there is no particular need to distinguish the speakers 85-1 and 85-2 from each other, the speakers 85-1 and 85-2 will be also referred to simply as the speakers 85.

In this example, the speaker 85-2 is longer than the speaker 85-1 in the lateral direction in the drawing, and these two speakers 85 constitute a speaker unit. Accordingly, the speaker 85-1 and the speaker 85-2 can be connected in parallel to one amplifier, and an acoustic signal of a right channel is supplied to these speakers 85, for example.

In a case where sound reproduction is performed with all the two speakers 84 in a display having such a configuration, for example, sound that has a high directivity in the horizontal direction in the drawing and is to spread in the vertical direction in the drawing is output.

Also, in a case where sound reproduction is performed with the speakers 84, when sound reproduction is performed with both the speaker 84-1 and the speaker 84-2, the directivity in the horizontal direction is higher than that to be achieved when sound reproduction is performed only with the speaker 84-2. Further, in a case where sound reproduction is performed only with the speaker 84-2, the directivity in the horizontal direction is higher than that in a case where sound reproduction is performed only with the speaker 84-1. The same also applies to sound reproduction using the speakers 85.

As described above, in the example indicated by the arrow Q12, it is possible to control the horizontal directivity of the sound to be reproduced in the drawing.

Further, in the example indicated by an arrow Q13, the speakers 84 and the speakers 85 provided in the example indicated by the arrow Q12 are further provided on the upper left side and the upper right side of the display unit 81 in the drawing, in the display shown in the example indicated by the arrow Q11.

Specifically, the speaker 84-1 and the speaker 84-2 are arranged in the lateral direction at an upper left portion of the display unit 81 in the drawing, along the upper edge of the display unit 81. The speaker 85-1 and the speaker 85-2 are also arranged in the lateral direction at an upper right portion of the display unit 81 in the drawing, along the upper edge of the display unit 81.

In this example, one speaker unit is formed with a total of six speakers that are the speakers 82 and the speakers 84. Accordingly, the speakers 82 and the speakers 84 can be connected in parallel to one amplifier, and an acoustic signal of a left channel is supplied to these speakers 82 and 84, for example.

Likewise, one speaker unit is formed with a total of six speakers that are the speakers 83 and the speakers 85. Accordingly, the speakers 83 and the speakers 85 can be connected in parallel to one amplifier, and an acoustic signal of a right channel is supplied to these speakers 83 and 85, for example.

Therefore, in a case where sound reproduction is performed with all the speakers 82-1 through 82-4, for example, sound that has a high directivity in the vertical direction in the drawing and is to spread in the horizontal direction in the drawing is output. Also, in a case where sound reproduction is performed with the speakers 82-1 through 82-4, it is possible to output sound having a higher directivity in the vertical direction than in a case where sound reproduction is performed with only one or two speakers 82.

Further, when sound reproduction is performed with a combination of the speaker 84-1 and the speaker 84-2, sound that has a high directivity in the horizontal direction in the drawing and is to spread in the vertical direction in the drawing can be output, as in the example indicated by the arrow Q12. In this case, the intensity of the directivity in the horizontal direction can be adjusted by changing the combination of the speakers 84 to be used for sound reproduction. The same also applies to sound reproduction using the speakers 83 and the speakers 85.

As described above, in the example indicated by the arrow Q13, directivity can be restricted either to the horizontal direction or to the vertical direction as viewed from the front of the display.

Note that although examples in which the speakers are arranged in a rectangular form have been described with reference to FIG. 3, the layout is not limited to a rectangular form, and the speakers may be arranged in any form such as a substantially circular shape, for example. Also, each speaker does not necessarily have a rectangular shape or the like, and may have any shape such as a circle shape.

Second Specific Example Application of the Present Technology

Figure 4:
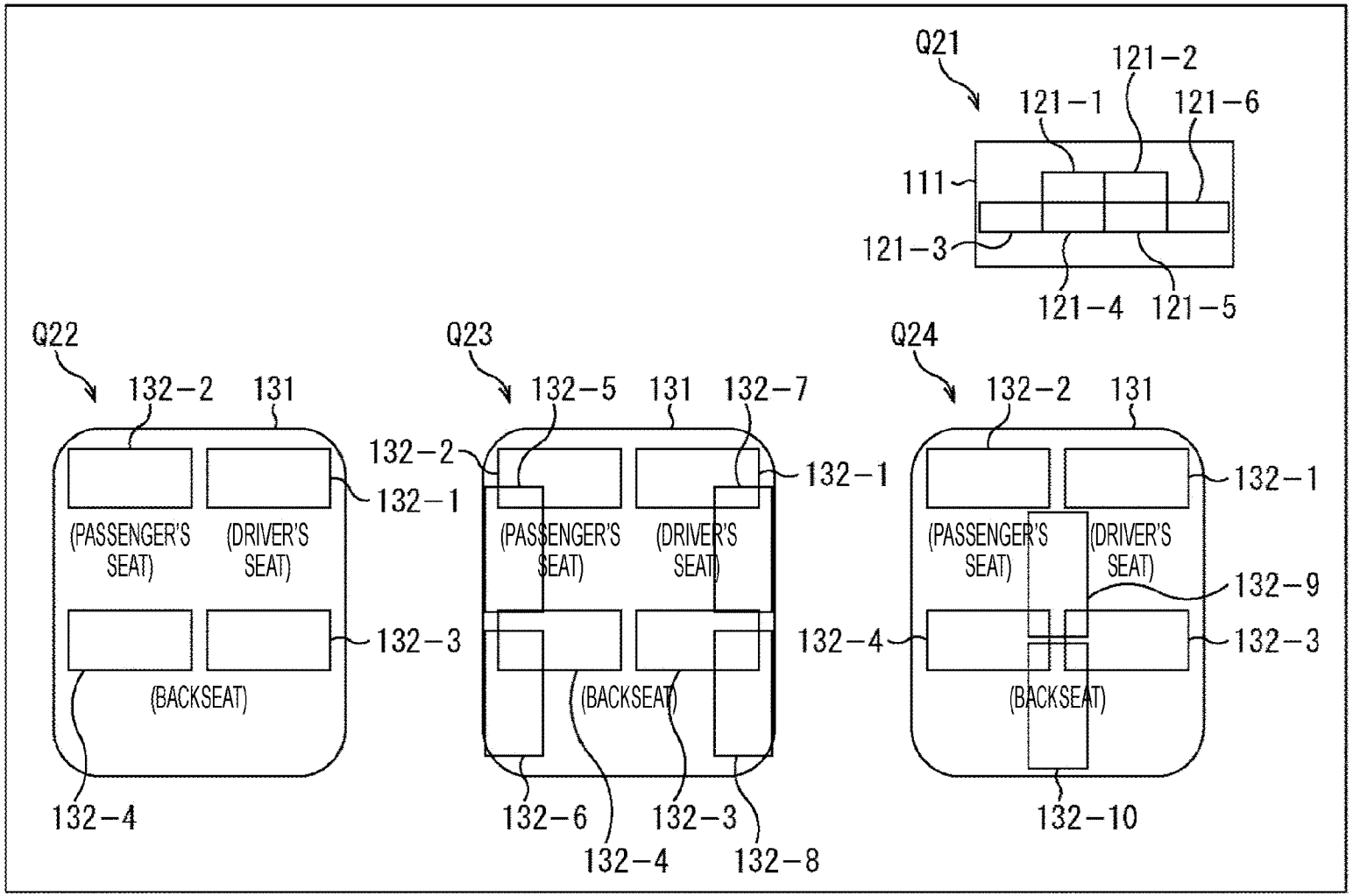
FIG. 4 is a diagram showing an example application of the present technology to an in-vehicle sound reproducing apparatus.

Further, FIG. 4 is a diagram for explaining a case where the present technology is applied to an in-vehicle sound reproducing apparatus. Note that the blocks corresponding to the instruction unit 21 through the switching unit 24 shown in FIG. 1 are not shown in each of the examples shown in FIG. 4.

For example, as indicated by an arrow Q21 in FIG. 4, one speaker unit 111 may be formed with six speakers 121-1 through 121-6 provided adjacent to one another. Note that, hereinafter, where there is no particular need to distinguish the speakers 121-1 through 121-6 from one another, the speakers 121-1 through 121-6 will be also referred to simply as the speakers 121.

Also, in a case where the speaker 121-1, the speaker 121-2, the speaker 121-4, and the speaker 121-5 are used for sound reproduction, the combination of these speakers 121 will be referred to as a first combination.

In a case where the speakers 121-3 through 121-6 are used for sound reproduction, on the other hand, the combination of these speakers 121 will be referred to as a second combination.

In this case, with the second combination, the length of the region formed with the combined speakers 121 in the lateral direction in the drawing is greater, or the region formed with the speakers 121 is longer in the lateral direction, than with the first combination. Accordingly, it is apparent that the directivity in the lateral direction (horizontal direction) in the drawing is higher.

In this case, four speaker units 132-1 through 132-4 may be mounted on the ceiling of a passenger vehicle 131 as indicated by an arrow Q22, for example.

Note that the drawing indicated by the arrow Q22 shows the seat portion of the passenger vehicle 131 as viewed from the ceiling, and the upper side of the drawing is the front of the passenger vehicle 131 in the drawing. Also, the right upper side in the drawing of the passenger vehicle 131 is the position of the driver's seat, the upper left side in the drawing is the position of the passenger's seat, and the lower side in the drawing is the position of the backseat.

In this example, the speaker unit 132-1 is disposed near the upper front side of the driver's seat of the passenger vehicle 131, the speaker unit 132-2 is disposed near the upper front side of the passenger's seat, and the speaker unit 132-3 and the speaker unit 132-4 are disposed on the right side and the left side, respectively, above the backseat.

Here, each of the speaker units 132-1 through 132-4 is a speaker unit having the same configuration as the speaker unit 111 indicated by the arrow Q21. Note that, hereinafter, where there is no particular need to distinguish the speaker units 132-1 through 132-4 from one another, the speaker units 132-1 through 132-4 will be also referred to simply as the speaker units 132.

In this example, the speakers constituting the speaker unit 132-1 and the speaker unit 132-3 are connected in parallel to one amplifier via a switching unit (not shown). Likewise, the speakers constituting the speaker unit 132-2 and the speaker unit 132-4 are connected in parallel to one amplifier via a switching unit (not shown).

Also, an acoustic signal of a right channel is supplied to the speaker unit 132-1 and the speaker unit 132-3, and an acoustic signal of a left channel is supplied to the speaker unit 132-2 and the speaker unit 132-4, for example.

Here, for example, when sound reproduction is performed with the first combination described above in the speaker unit 132-2 and the speaker unit 132-4, for example, sound reproduction can be performed with the second combination in the speaker unit 132-1 and the speaker unit 132-3.

In this case, in the row of the driver's seat on the right side in the drawing, sound having a high directivity in the horizontal direction in the drawing is output to the driver and the like. In the row of the passenger's seat on the left side in the drawing, on the other hand, sound having a relatively low directivity is output to the user(s) in those seats.

Accordingly, on the side of the row of the driver's seat, reproduced sound such as voice guidance can be heard more clearly than on the side of the row of the passenger's seat. In other words, the feeling of separation of sound becomes stronger between the driver's seat side and the passenger's seat side.

The directions in which directivity is high do not vary with differences in the body shape between the persons in the driver's seat and the passenger's seat, or hardly varies with differences in the height of the positions of the ears of the persons, because the second combination in the speaker units 132 is long in the lateral direction. Thus, preferred sound reproducing environments can be provided.

Note that, in this example, sound reproduction may be performed with the first combination in the speaker units 132-2 through 132-4, and sound reproduction may be performed with the second combination only in the speaker unit 132-1.

Alternatively, in the example indicated by an arrow Q23, speaker units 132-5 through 132-8 are further provided in the example indicated by the arrow Q22.

Specifically, the speaker units 132-5 through 132-8 are provided on the outer side of the passenger's seat, the left outer side of the backseat, the outer side of the driver's seat, and the right outer side of the backseat, respectively.

These speaker units 132-5 through 132-8 are speaker units each having the same configuration as the speaker unit 111 indicated by the arrow Q21. Note that, hereinafter, where there is no particular need to distinguish the speaker units 132-1 through 132-8 from one another, the speaker units 132-1 through 132-8 will be also referred to simply as the speaker units 132.

In this example, the speakers constituting the speaker unit 132-1, the speaker unit 132-3, the speaker unit 132-7, and the speaker unit 132-8 are connected in parallel to one amplifier via a switching unit (not shown).

Likewise, the speakers constituting the speaker unit 132-2, the speaker unit 132-4, the speaker unit 132-5, and the speaker unit 132-6 are connected in parallel to one amplifier via a switching unit (not shown).

Also, an acoustic signal of a right channel is supplied to the speaker unit 132-1, the speaker unit 132-3, the speaker unit 132-7, and the speaker unit 132-8, for example. On the other hand, an acoustic signal of a left channel is supplied to the speaker unit 132-2, the speaker unit 132-4, the speaker unit 132-5, and the speaker unit 132-6.

In this example, sound reproduction can be performed with the second combination in the speaker unit 132-1 and the speaker unit 132-7, while sound reproduction is performed with the first combination in the remaining speaker units 132, for example.

In this case, sound having a higher directivity than those in the other seats is output toward the driver's seat. Accordingly, reproduced sound such as voice guidance can be heard more clearly in the driver's seat.

The directions in which directivity is high do not vary with differences in the body shape between the persons in the driver's seat and the passenger's seat, or hardly varies with differences in the height of the positions of the ears of the persons, because the second combination in the speaker units 132 is long in the lateral direction. Thus, preferred sound reproducing environments can be provided.

Further, in the example indicated by an arrow Q24, a speaker unit 132-9 and a speaker unit 132-10 are further provided in the example indicated by the arrow Q22.

Specifically, the speaker unit 132-9 and the speaker unit 132-10 are provided above the portion between the driver's seat and the passenger's seat and above the center of the backseat, respectively.

These speaker units 132-9 and 132-10 are also speaker units each having the same configuration as the speaker unit 111 indicated by the arrow Q21. Note that, hereinafter, where there is no particular need to distinguish the speaker units 132-1 through 132-4, the speaker unit 132-9, and the speaker unit 132-10 from one another, these speaker units will be also referred to simply as the speaker units 132.

In this example, the speakers constituting the speaker unit 132-1 and the speaker unit 132-3 are connected in parallel to one amplifier via a switching unit (not shown), and an acoustic signal of a right channel is supplied to these speakers. Likewise, the speakers constituting the speaker unit 132-2 and the speaker unit 132-4 are connected in parallel to one amplifier via a switching unit (not shown), and an acoustic signal of a left channel is supplied to these speakers.

Also, the speakers constituting the speaker unit 132-9 and the speaker unit 132-10 are connected in parallel to one amplifier via a switching unit (not shown), and an acoustic signal of a center channel is supplied to these speakers.

Note that, in a case where there is no center channel acoustic signal, acoustic signals of a right channel and a left channel are combined by a predetermined method, to generate a pseudo center channel acoustic signal.

In this example, sound reproduction can be performed with the second combination in the speaker unit 132-9, while sound reproduction is performed with the first combination in the remaining speaker units 132, for example.

In this case, sound having a higher directivity than those in the other seats is output toward the front seats of the passenger vehicle 131, which are the driver's seat and the passenger's seat. Accordingly, reproduced sound such as voice guidance can be heard more clearly in the driver's seat and the passenger's seat.

The directions in which directivity is high do not vary with differences in the body shape between the persons in the driver's seat and the passenger's seat, or hardly varies with differences in the height of the positions of the ears of the persons, because the second combination in the speaker units 132 is long in the lateral direction. Thus, preferred sound reproducing environments can be provided.

Note that, in the examples shown in FIG. 4, the speakers 121 may be arranged in any form such as a substantially circular form, and the speakers 121 do not necessarily have a rectangular shape and may have any shape such as a circular shape, for example.

Directivity of Sound

The directivity of sound to be output from a speaker unit is now described.

Figure 5:
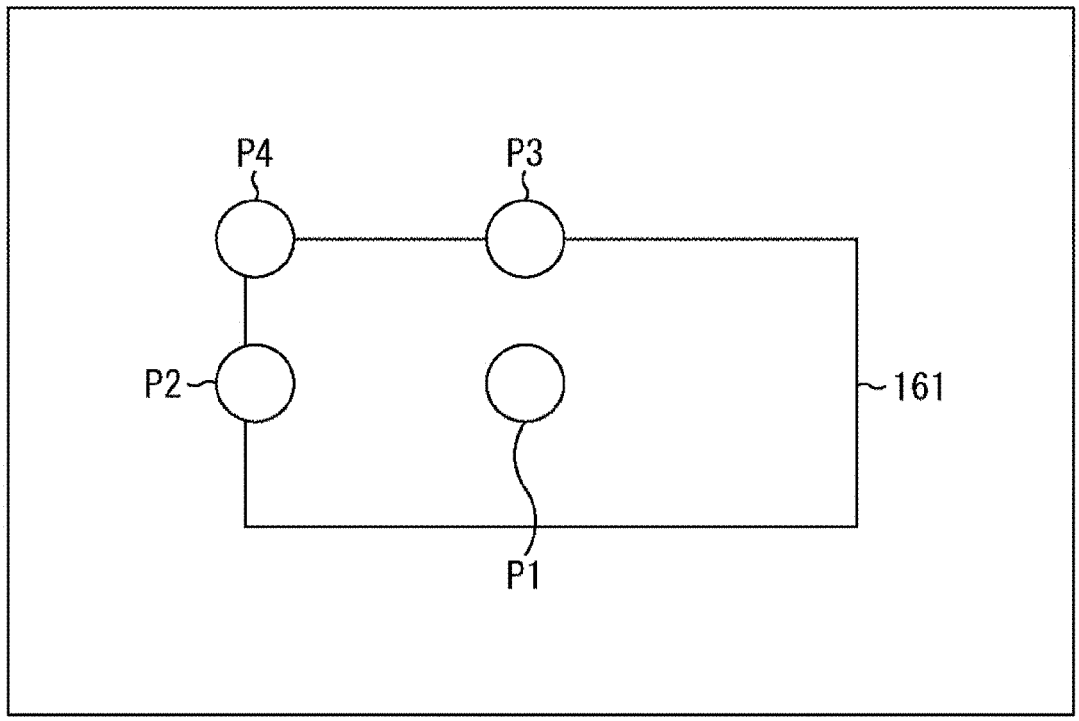
FIG. 5 is a diagram for explaining directivity of sound.

For example, a rectangular speaker 161 that is long in the lateral direction as shown in FIG. 5 is described herein. The speaker 161 is a speaker that have the characteristics of a capacitive load, corresponding to the speakers 51 shown in FIG. 1, for example.

Here, a position substantially at the center of the speaker 161 is set as a position P1, and a position substantially at the center of a short side located farther from the position P1, or a position substantially at the center of the left edge of the speaker 161 in the drawing, is set as a position P2.

Also, a position substantially at the center of a long side located closer to the position P1, or a position substantially at the center of the upper edge of the speaker 161 in the drawing, is set as a position P3, and a position farthest from the position P1, or the position at the upper left corner of the rectangular speaker 161 in the drawing, is set as a position P4.

In this example, microphones for enabling frequency measurement from the front of the speaker 161 are installed to face the respective positions P1 through P4, and the speaker 161 is made to output sound so that frequency measurement is conducted.

Figure 6:
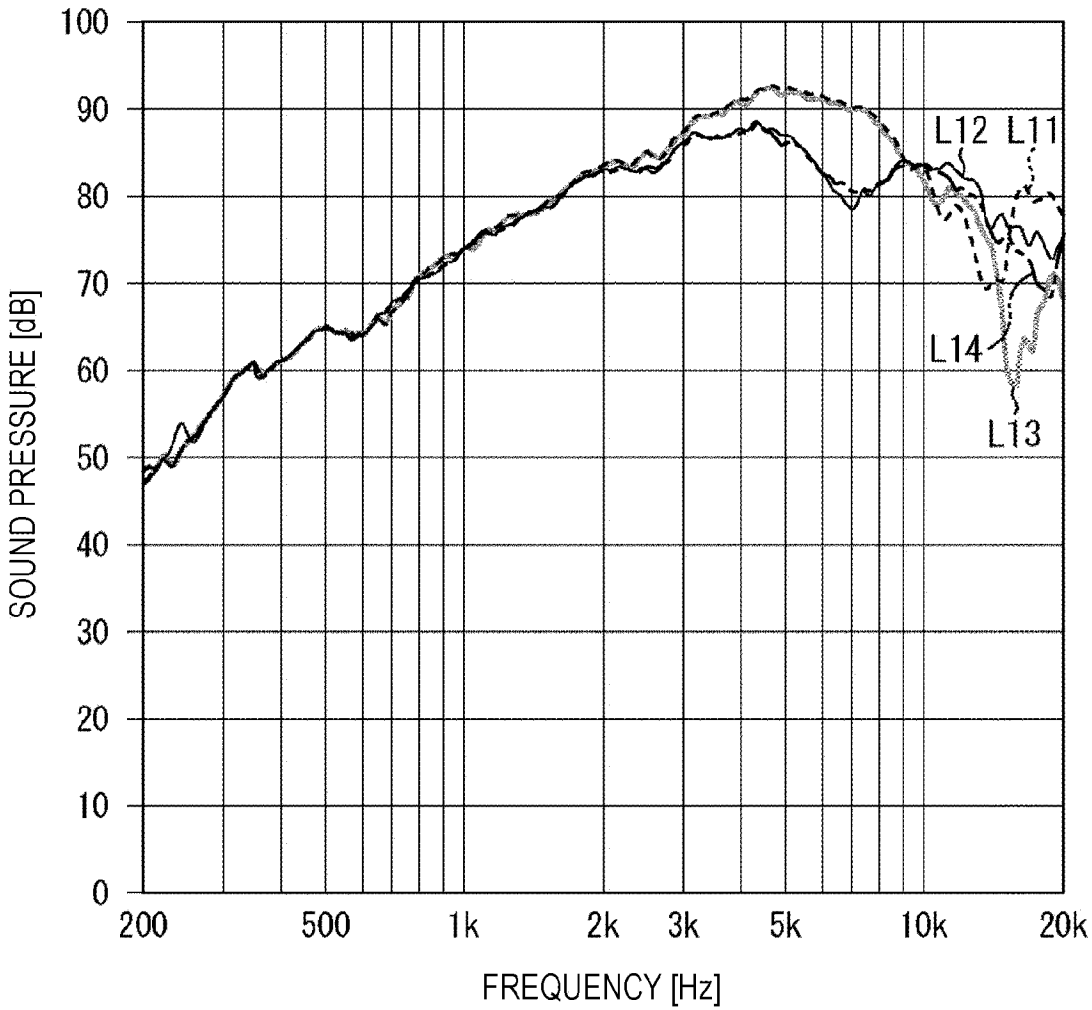
FIG. 6 is a diagram for explaining directivity of sound.

In this case, the measurement results shown in FIG. 6 are obtained with respect to the respective positions P1 through P4, for example. Note that, in FIG. 6, the ordinate axis indicates sound pressure, and the abscissa axis indicates frequency. Further, curves L11 through L14 indicate the sound pressure measurement results conducted by the respective microphones installed to face the positions P1 through P4.

As can be seen from FIG. 6, the measurement results can be roughly divided into a frequency characteristics group at the position P1 and the position P3, and a frequency characteristics group at the position P2 and the position P4.

Where the measurement results at the position P2 and the position P4, or the measurement results at a long-side edge portion of the rectangular speaker 161, are compared with the measurement results at the substantially center position P1 and the position P3 at a short-side edge portion, it becomes apparent that the sound pressures at the position P2 and the position P4 are attenuated to lower pressures than the sound pressures at the position P1 and the position P3 in the frequency bands at 3 kHz and higher.

In this case, even if the listener who is listening to the sound being output from the speaker 161 moves from the center position P1 to the position P3, the listener hardly notice any difference in the sound pressure and the sound he/she is listening to.

On the other hand, if the listener moves from the center position P1 to the position P2, attenuation in the high frequency range is clearly heart, and therefore, the listener notices such a directivity that the sound source is not directed to the listener.

In a case where the shape of the speaker 161, or more specifically, the shape of the diaphragm of the speaker 161, is a rectangular shape, the directivity is high in the long-side direction of the rectangle. However, the directivity is low in the short-side direction, and sound tends to spread in that direction.

It should be understood that there is a tendency similar to the above not only in a case where sound reproduction is performed with the single speaker 161 but also in a case where sound reproduction is performed with a combination of speakers, as long as the speakers to be used for sound reproduction correspond to the speaker 161.

As is apparent from such measurement results, it is possible to control the direction and the intensity of directivity by appropriately changing the combination of the speakers 51 to be used for sound reproduction in accordance with instruction information in the sound reproducing apparatus 11 shown in FIG. 1.

Number of Speakers and Sound Pressure

Figure 7:
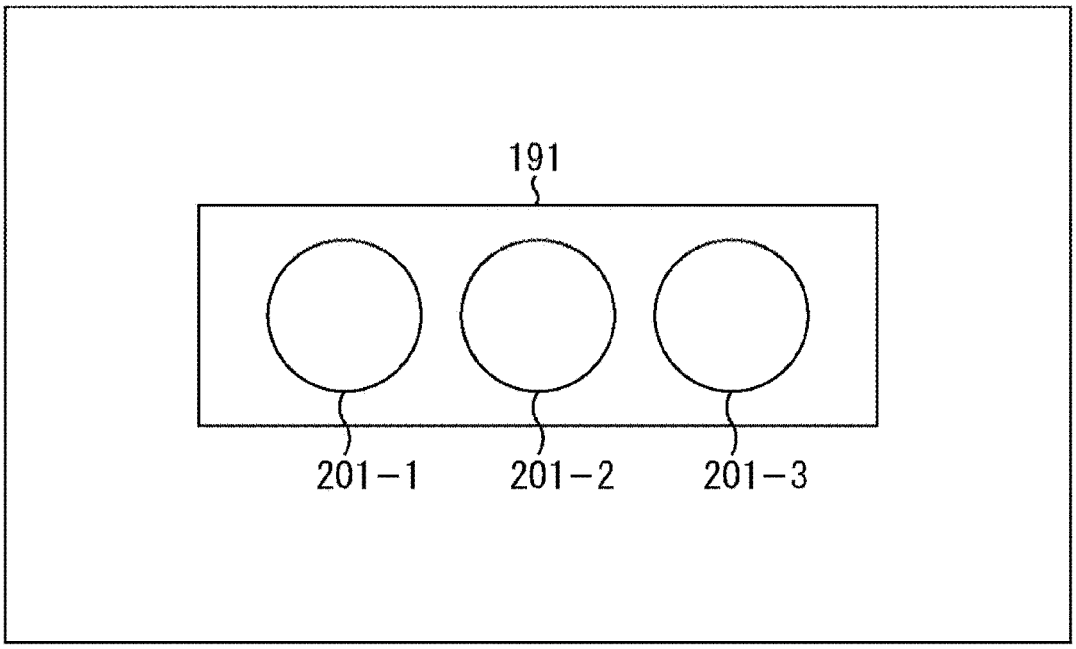
FIG. 7 is a diagram for explaining the relationship between the number of speakers and sound pressure.
Figure 8:
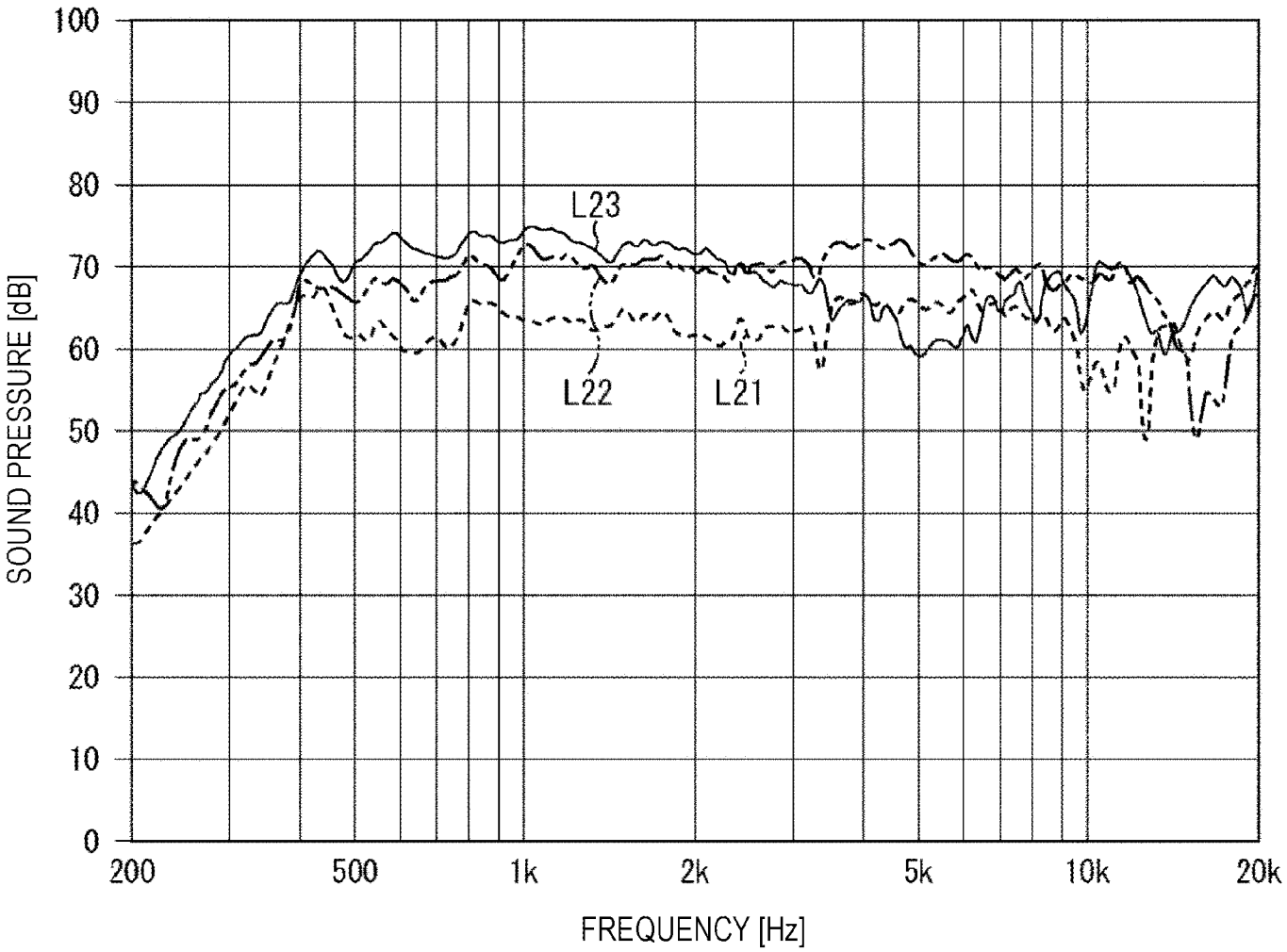
FIG. 8 is a diagram for explaining the relationship between the number of speakers and sound pressure.

Referring now to FIGS. 7 and 8, the relationship between the number of parallel-connected speakers to be used for sound reproduction and sound pressure is described.

For example, a case where one speaker unit 191 is formed with three circular speakers 201-1 through 201-3 as shown in FIG. 7 is described.

Here, the speaker unit 191 corresponds to the speaker unit 25 shown in FIG. 1, and the respective speakers 201-1 through 201-3 correspond to the speakers 51 shown in FIG. 1. Note that, hereinafter, where there is no particular need to distinguish the speakers 201-1 through 201-3 from one another, the speakers 201-1 through 201-3 will be also referred to simply as the speakers 201.

In this example, three speakers 201 are arranged in the lateral direction in the drawing. These three speakers 201 can also be connected in parallel to one amplifier via a switching unit (not shown).

In this example, frequency characteristics were measured while the number of the speakers 201 used for sound reproduction was changed, and the measurement results shown in FIG. 8 were obtained. Note that, in FIG. 8, the ordinate axis indicates sound pressure, and the abscissa axis indicates frequency.

Also, in FIG. 8, a curve L21 indicates the measurement result obtained in a case where sound reproduction was performed only with one speaker 201, a curve L22 indicates the measurement result obtained in a case where sound reproduction was performed with two speakers 201, and a curve L23 indicates the measurement result obtained in a case where sound reproduction was performed with three speakers 201.

As can be seen from FIG. 8, it is possible to increase sound pressure by increasing the number of the speakers 201 to be used for sound reproduction in the region where the frequency is 2 kHz or lower. In this example, as the number of the speakers 201 to be used for sound reproduction becomes larger, a higher sound pressure is obtained.

In other words, it is difficult to obtain a sufficiently high sound pressure in a low frequency range with a speaker having the characteristics of a capacitive load. However, where a plurality of speakers 201 are used in this manner, it is possible to compensate for the sound pressure shortage in the low frequency range.

In the region where the frequency is 2 kHz or higher, on the other hand, the relationship in the case where the frequency is 2 kHz or lower is not necessarily observed as the relationship between the number of speakers 201 and sound pressure. For example, it is apparent that the frequency characteristics obtained when three speakers 201 are used for sound reproduction tend to have a portion that is lower than the sound pressure in the intermediate frequency range.

However, in a case where three speakers 201 are used for sound reproduction, signal processing is performed on the portion with the lowered sound pressure by the acoustic characteristics correction unit 31, so that the frequency characteristics are corrected. Thus, high sound quality can be achieved over a wider frequency band.

Because of this, where the number of speakers to be used for sound reproduction is increased, the listener can listen to excellent sound with adjusted sound pressure in the low and intermediate frequency ranges.

As is apparent from the above, it is possible to adjust the intensity of directivity in a desired direction and increase/decrease sound pressure by appropriately changing the combination of the speakers 51 to be used for sound reproduction in accordance with instruction information in the sound reproducing apparatus 11 shown in FIG. 1. In addition to that, sound can be output from a specific position in accordance with instruction information, for example, and frequency characteristics correction such as high frequency emphasis can be performed.

Impedances of Speakers

Figure 9:
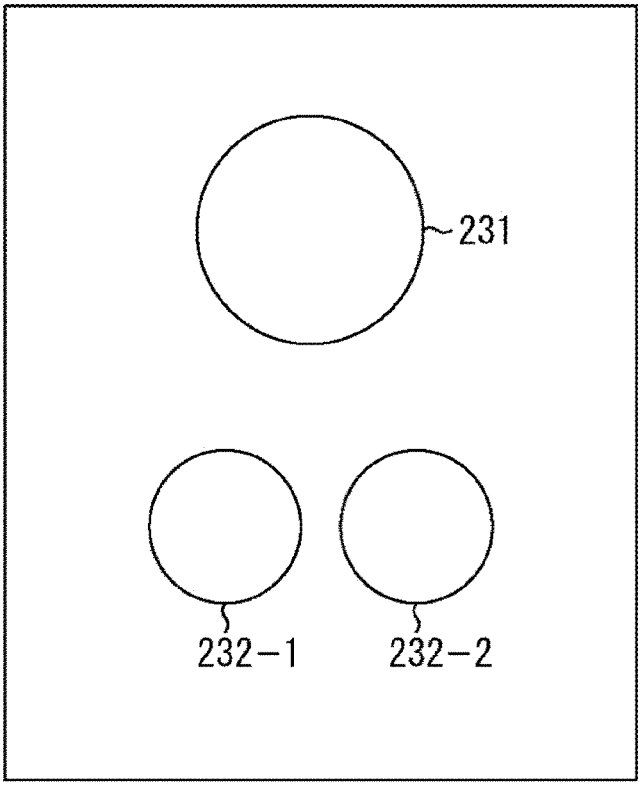
FIG. 9 is a diagram for explaining the impedance of a speaker.
Figure 10:
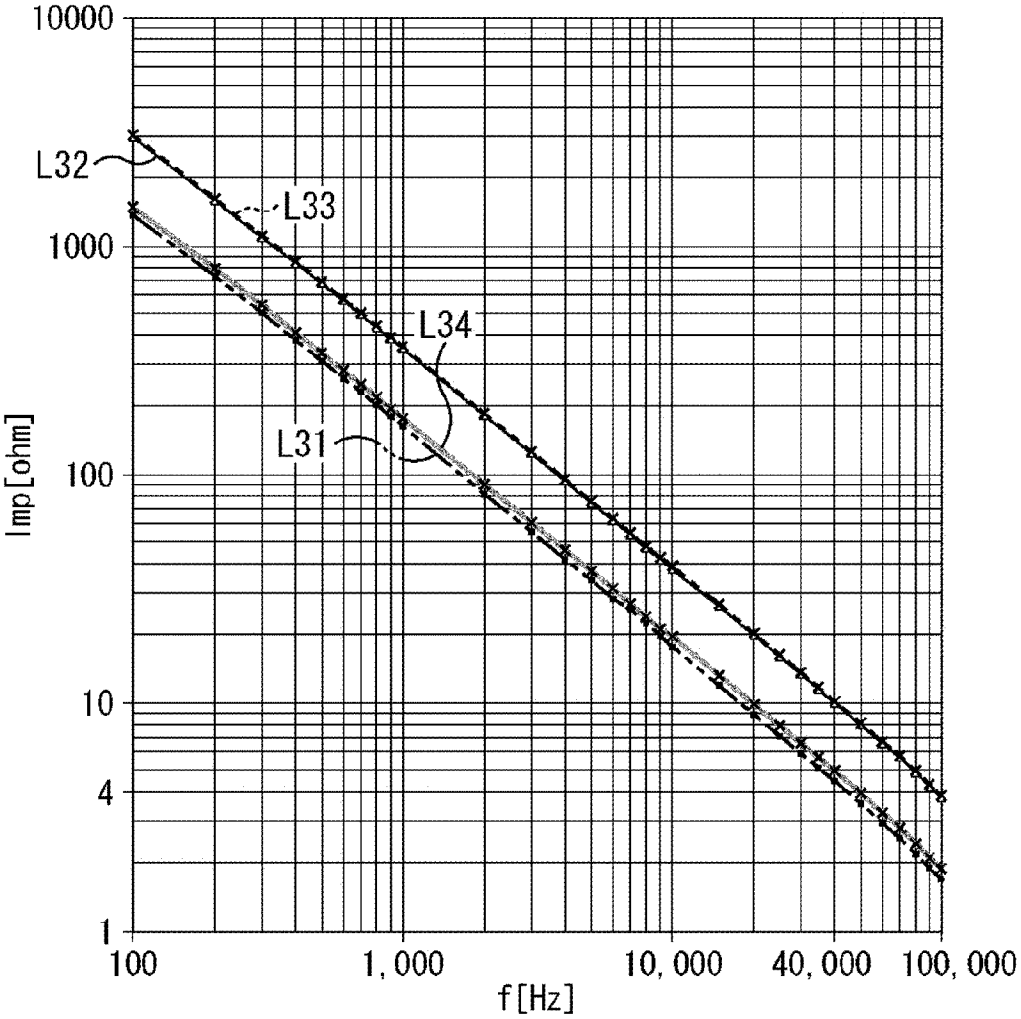
FIG. 10 is a diagram for explaining the impedance of the speaker.

Further, referring now to FIGS. 9 and 10, the impedances of speakers is described.

For example, a speaker unit may be formed with a large-diameter circular speaker 231 and two small-diameter circular speakers 232-1 and 232-2, and these speakers can be connected in parallel, as shown in FIG. 9.

Here, the speaker 232-1 and the speaker 232-2 are of the same size. Note that, hereinafter, where there is no particular need to distinguish the speaker 232-1 and the speaker 232-2 from each other, the speaker 232-1 and the speaker 232-2 will be also referred to simply as the speakers 232.

Here, the speaker 231 and the speakers 232 each have the characteristics of a capacitive load, and the radius ratio between the circular diaphragm of the speaker 231 and the circular diaphragm of each speaker 232 is 1.5:1.0.

In such a case, the impedances of speakers were measured in the following four cases: a case with the single speaker 231, a case with the single speaker 232-1, a case with the single speaker 232-2, and a case where the two speakers 232 are connected in parallel. The measurement results shown in FIG. 10 were obtained.

Note that, in FIG. 10, the abscissa axis indicates frequency, and the ordinate axis indicates impedance. Also, in FIG. 10, a curve L31 indicates the impedance of the single speaker 231, a curve L32 indicates the impedance of the single speaker 232-1, and a curve L33 indicates the impedance of the single speaker 232-2. Further, a curve L34 indicates the impedance obtained when the two speakers 232 are connected in parallel.

The area ratios among the respective speakers, which are the speaker 231, the two parallel-connected speakers 232, the speaker 232-1, and the speaker 232-2, are 2.25:2.0:1.0:1.0. As can be seen from the measurement results shown in FIG. 10, the impedance decreases with the area ratios. Particularly, the speaker 231 having a large area has a lower impedance on the amplifier than that of each speaker 232 having a small area, and is lower than 4 ohms at high frequencies of 40 kHz and higher.

Here, the speaker 231 having a large area is used as the speaker unit 25 in the sound reproducing apparatus 11 shown in FIG. 1, for example. In this case, when the output impedance of the amplifier 23 is 4 ohms, the current output to be supplied to the speaker 231 is limited, and the performance of the speaker 231 is degraded. The same also applies in a case where the two speakers 232 are connected in parallel and are then used.

Alternatively, a speaker 232 having a small area is used as the speaker unit 25 in this situation. The impedance of the speaker 232 is 10 ohms at a high frequency of 40 kHz, and the speaker 232 has impedance characteristics that exceed 4 ohms up to a frequency as high as about 100 kHz. Accordingly, in a case where a single speaker 232 is used, it is possible to prevent degradation of the performance of the speaker 232.

As is apparent from the above, if the number of speakers to be used for sound reproduction, or the number of parallel-connected speakers, is changed in a case where a speaker unit is formed with a plurality of speakers, the impedance of the speakers fluctuates with the number of the speakers at a high rate in the high frequency range. Accordingly, in the sound reproducing apparatus, a high-frequency protection process for appropriately protecting the speakers is performed in accordance with the number of the speakers to be used for sound reproduction. Thus, safe sound reproduction can be performed in a preferred manner.

Second Embodiment

Example Configuration of a Sound Reproducing Apparatus

Note that in the above described examples, some speakers among the plurality of speakers constituting a speaker unit are selectively connected in parallel to an amplifier, so that the directivity of sound can be controlled. Alternatively, it is possible to control directivity by moving a speaker unit, for example.

Figure 11:
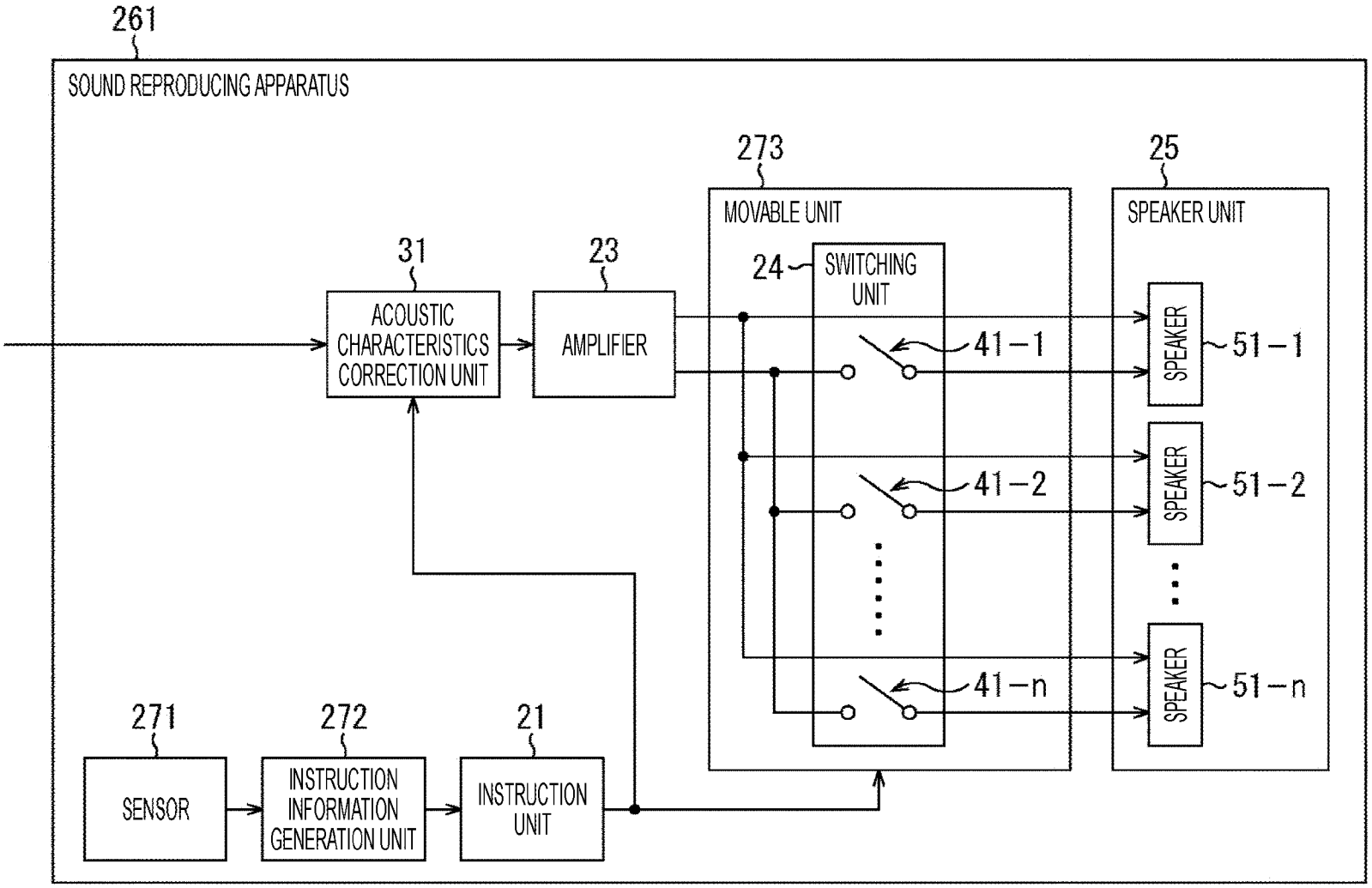
FIG. 11 is a diagram showing an example configuration of a sound reproducing apparatus.

In such a case, a sound reproducing apparatus is designed as shown in FIG. 11, for example. Note that, in FIG. 11, the components equivalent to those shown in FIG. 1 are denoted by the same reference numerals as those used in FIG. 1, and explanation of them will not be unnecessarily repeated.

The sound reproducing apparatus 261 shown in FIG. 11 includes a sensor 271, an instruction information generation unit 272, an instruction unit 21, an acoustic characteristics correction unit 31, an amplifier 23, a movable unit 273, a switching unit 24, and a speaker unit 25.

The sensor 271 is formed with a human sensor, a microphone, an ultrasonic sensor, an image sensor, or the like, for example. The sensor 271 detects a user who is a listener of sound reproduced by the sound reproducing apparatus 261, and outputs the detection result to the instruction information generation unit 272. For example, the sensor 271 detects a user in the vicinity of the sound reproducing apparatus 261 as a listener.

The instruction information generation unit 272 generates instruction information in accordance with the detection result supplied from the sensor 271, and supplies the instruction information to the instruction unit 21. The instruction unit 21 also supplies the instruction information supplied from the instruction information generation unit 272 to the acoustic characteristics correction unit 31 and the movable unit 273.

Note that, although an example in which the instruction unit 21 acquires the instruction information from the instruction information generation unit 272 is described herein, the instruction unit 21 may acquire a user detection result from the sensor 271, and generate instruction information in accordance with the detection result. Alternatively, instruction information may be supplied by a user's input or the like, without the use of the sensor 271.

In a case where the sensor 271 is formed with a human sensor, for example, when the position of a user is detected by the sensor 271, the instruction information generation unit 272 generates instruction information so that the sound to be output has directivity in a predetermined direction such as an upward/downward direction or a rightward/leftward direction, in accordance with the result of the detection of the user's position. At this stage, the intensity of the directivity may also be controlled in accordance with the instruction information.

Specifically, in a case where a plurality of users are detected, for example, instruction information is generated so that the directivity is weakened with respect to the direction in which these users stand in line, or instruction information is generated so that sound is output toward the detected users. Also, in a case where a plurality of users are detected, other than this, a check may be made to determine whether the detected users are not asleep, or determine whether the users are viewing the presented content or the like or whether the users are asleep, in accordance with the amounts of displacement or the like of the objects (the users or portions of the users) per predetermined time, for example. In this case, only the users who are viewing the content or the like are regarded as the detected users, and instruction information is generated so that directivity to these users is weakened. In this manner, it is possible to prevent the sleeping users from feeling discomfort.

The sensor 271 may be of any kind, as long as the positions of users can be detected. For example, even if a microphone is used as the sensor 271, the position of a user can be detected from the arrival direction of sound from the user. Also, even if an image sensor, or a camera, is used as the sensor 271, the position of a user can be detected through an analysis process, an image recognition process, or the like performed on an image captured by the sensor 271.

In addition to that, the acoustic characteristics correction unit 31 performs a process of correcting the acoustic characteristic of an acoustic signal supplied from the outside, in accordance with the instruction information from the instruction unit 21. The resultant acoustic signal is supplied to the amplifier 23.

The movable unit 273 is formed with the switching unit 24 and a drive system such as an actuator (not shown), for example. In accordance with the instruction information supplied from the instruction unit 21, the movable unit 273 causes the switching unit 24 to control connections between the speakers 51 and the amplifier 23, and causes the speaker unit 25 to physically move.

Note that, although an example in which the speaker unit 25 is formed with a plurality of speakers 51 is described herein, the speaker unit 25 may be formed with a single speaker 51 that has an appropriate shape such as a quadrangular shape and has a large area, for example.

In the sound reproducing apparatus 261, the speaker unit 25 is disposed so that part of or all the speaker unit 25 is hidden by a shielding member provided in advance, when viewed from a predetermined direction, or when viewing from a listener of the sound, for example. In this case, the movable unit 273 moves the speaker unit 25 in accordance with the instruction information, to change the region where the speaker unit 25 is exposed through the shielding member as viewed from the listener.

As the shape and the area of the exposed region of the speaker unit 25 are changed in the above manner, it is possible to change the directivity characteristics of the sound to be output from the speaker unit 25. Note that the region of the portion exposed to the listener in the speaker unit 25, or the region not hidden by the shielding member in the speaker unit 25, will be hereinafter also referred to as the exposed region.

For example, if the movable unit 273 moves the speaker unit 25 to make the exposed region a long rectangular region, it is possible to realize such sound reproduction that gives directivity in the long-side direction of the rectangle. Also, in such a state, if the movable unit 273 further moves the speaker unit 25 so that the ratio between the long side and the short side of the exposed region becomes smaller, it is possible to weaken the directivity of the sound. Furthermore, the speaker unit 25 can be hidden by the shielding member. Thus, it is possible to perform appropriate directivity control, and secure sufficient sound pressure in low frequency ranges, by increasing the area of the speaker unit 25 by a certain amount.

Note that, although an example case where the movable unit 273 electrically moves the speaker unit 25 is described herein, a user or the like may manually move the speaker unit 25 by operating the movable unit 273.

Also, instead of moving the entire speaker unit 25, the movable unit 273 may move the speakers 51 constituting the speaker unit 25 independently of one another, or divide the speakers 51 constituting the speaker unit 25 into several speaker groups and move those speaker groups independently of one another.

Further, instead of moving the speaker unit 25, the movable unit 273 may move the shielding member, to move the speaker unit 25 relative to the shielding member. In other words, with the movable unit 273, it should be possible to change the relative position of the speaker unit 25 with respect to the shielding member.

In the example shown in FIG. 11, the speaker unit 25 is formed with a plurality of speakers 51, instead of a single speaker. Accordingly, when the directivity of the sound to be output is controlled in the sound reproducing apparatus 261, the control can be performed through a combination of movement of the position of the speaker unit 25 and switching of the speakers 51 to be used for sound reproduction. As a result, it becomes possible to perform finer control such as control on sound pressure and the stereotactic position of the sound source.

Further, the acoustic characteristics correction unit 31 performs acoustic characteristics correction such as waveform equalization, depending on the sound quality of the sound at a time of sound reproduction determined in accordance with the characteristics, the number, and the positions of the speakers 51 to be used for the sound reproduction, the size, the shape, the exposure position, and the like of the exposed region of the speaker unit 25. Specifically, when the directivity of sound changes with movement of the speaker unit 25, for example, the frequency characteristics changes with the change. Therefore, a process of correcting the change in the frequency characteristics is performed by the acoustic characteristics correction unit 31.

Also, the sound reproducing apparatus 261 does not include the high-frequency protection unit 32 shown in FIG. 1. However, in a case where the area of the speaker unit 25 is large, or where the number of the speakers 51 to be used for sound reproduction is large, and the impedance at high frequency is low, the high-frequency protection unit 32 may be provided, or the acoustic characteristics correction unit 31 may perform a process of protecting high frequency ranges. For example, in a case where the high-frequency protection unit 32 is provided, the high-frequency protection unit 32 should be disposed between the acoustic characteristics correction unit 31 and the amplifier 23.

As the sound reproducing apparatus 261 is designed as described above, it is possible to increase the degree of freedom in the entire system, and realize preferred sound reproduction with excellent directivity characteristics at low costs while compensating for sound pressure shortage in the low frequency ranges due to the characteristics of a capacitive load.

Note that, in the sound reproducing apparatus 11 shown in FIG. 1, the sensor 271 and the instruction information generation unit 272 may also be provided, and instruction information corresponding to a result of detection performed by the sensor 271 to detect a user near the sound reproducing apparatus 11 may be output from the instruction unit 21.

Description of a Sound Reproduction Process

Figure 12:
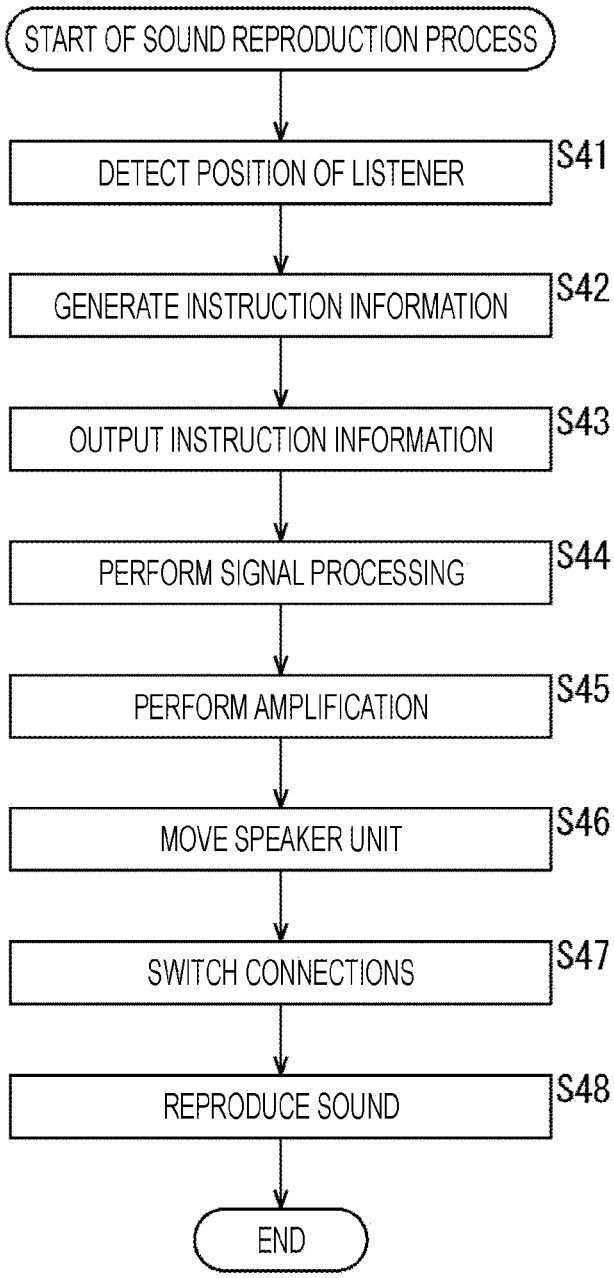
FIG. 12 is a flowchart for explaining a sound reproduction process.

Next, operation of the sound reproducing apparatus 261 is described. Specifically, referring now to the flowchart in FIG. 12, a sound reproduction process to be performed by the sound reproducing apparatus 261 is described below.

In step S41, the sensor 271 detects the position of a listener, and supplies the detection result to the instruction information generation unit 272.

In step S42, the instruction information generation unit 272 generates instruction information in accordance with the detection result supplied from the sensor 271, and supplies the instruction information to the instruction unit 21.

In step S43, the instruction unit 21 supplies the instruction information supplied from the instruction information generation unit 272 to the acoustic characteristics correction unit 31 and the movable unit 273. Through the above processing in steps S41 through S43, the instruction unit 21 outputs the instruction information corresponding to the result of detection performed by the sensor 271 to detect a user (a listener).

Figure 2:
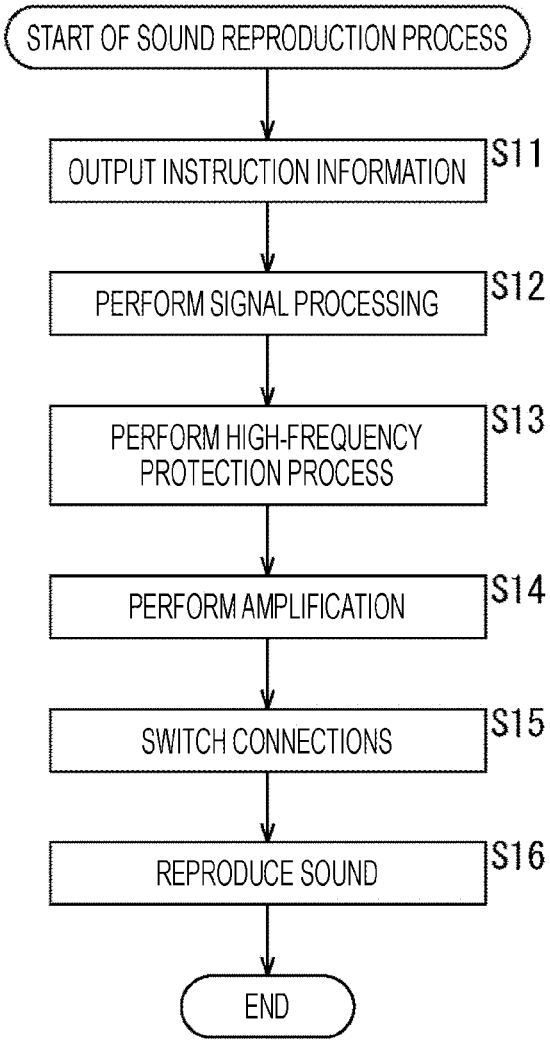
FIG. 2 is a flowchart for explaining a sound reproduction process.

In step S44, the acoustic characteristics correction unit 31 performs signal processing on an externally supplied acoustic signal in accordance with the instruction information supplied from the instruction unit 21, and supplies the resultant acoustic signal to the amplification unit 23. Note that, in step S44, processing similar to the processing in step S12 in FIG. 2 is performed.

In step S45, the amplifier 23 amplifies the acoustic signal supplied from the acoustic characteristics correction unit 31, and supplies the amplified acoustic signal to the switching unit 24.

In step S46, the movable unit 273 moves the speaker unit 25, in accordance with the instruction information supplied from the instruction unit 21. Here, the speaker unit 25 is moved for the purpose indicated by the instruction information, or to achieve desired directivity characteristics, for example.

In step S47, the switching unit 24 selects the speakers 51 to be used for sound reproduction in accordance with the instruction information supplied from the instruction unit 21, and switches connections between the respective speakers 51 and the amplifier 23 in accordance with the selection result. That is, in step S47, processing similar to the processing in step S15 in FIG. 2 is performed.

As a result, only the speakers 51 to be used for sound reproduction are connected in parallel to the amplifier 23, and the acoustic signal output from the amplifier 23 is supplied to the speakers 51 to be used for sound reproduction via the switches 41 that have been turned on.

Note that, in the processing in step S41, instruction information may be supplied through a user's input or the like, without the use of the sensor 271. Also, the processing in step S46 and the processing in step S47 may be performed at any timing after the processing in step S43 is performed and before the processing in step S48 is performed.

In step S48, the speakers 51 reproduce sound in accordance with the acoustic signal supplied from the amplifier 23, and the sound reproduction process then comes to an end.

As described above, the sound reproducing apparatus 261 selects the speakers 51 to be used for sound reproduction in accordance with instruction information, and performs sound reproduction by connecting only the selected speakers 51 in parallel to the amplifier 23 and moving the speaker unit 25 in accordance with the instruction information.

By virtue of this configuration, it is possible to realize sound reproduction with high sound quality and excellent directivity characteristics at low costs, using the speakers 51 having the characteristics of a capacitive load. Particularly, in the sound reproducing apparatus 261, one or a plurality of speakers 51 are selectively used for sound reproduction, and the speaker unit 25 is moved to appropriately expose part or all the speaker unit 25. Thus, desired directivity characteristics can be easily achieved.

First Specific Example Application of the Present Technology

Next, a more specific example application of the present technology described in the second embodiment is described.

Figure 13:
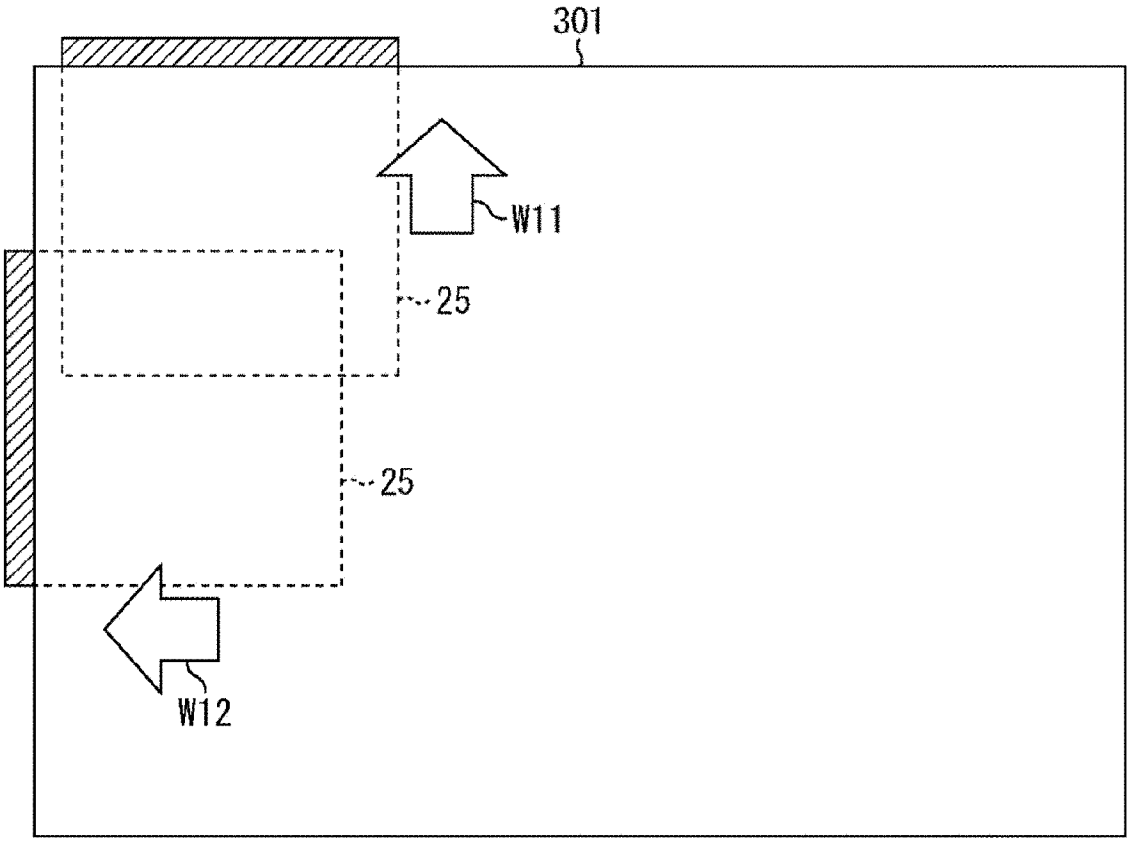
FIG. 13 is a diagram showing an example application of the present technology to a television receiver.

FIG. 13 is a diagram for explaining a case where the present technology is applied to a television receiver, for example. Note that, in FIG. 13, the components equivalent to those shown in FIG. 11 are denoted by the same reference numerals as those used in FIG. 11, and explanation of them will not be unnecessarily repeated. Also, in the example shown in FIG. 13, the blocks corresponding to the sensor 271 through the movable unit 273 shown in FIG. 11, or the blocks other than the speaker unit 25, are not shown.

In the example shown in FIG. 13, the television receiver to which the present technology is applied includes a display unit 301 that displays an image, and a speaker unit 25 disposed on the back side of the display unit 301. Also, in this example, a plurality of speakers 51 (not shown) are arranged in a square form, to constitute the speaker unit 25.

Note that, although only the speaker unit 25 that reproduces the sound of the left channel of the content to be reproduced is shown in this drawing, the television receiver also includes a speaker unit (not shown) that reproduces the sound of the right channel. In addition to that, although two speaker units 25 are drawn here for easier understanding, only one speaker unit 25 is provided in practice.

FIG. 13 shows the display unit 301 viewed from the front by a user, and the speaker unit 25 is disposed behind the display unit 301 as viewed from the user. Specifically, in this example, the display unit 301 is the above described shielding member, and part of or all the speaker unit 25 is hidden behind the display unit 301 and cannot be seen from the user, depending on the position of the speaker unit 25.

Particularly, in this example, each of the shaded portions of the speaker unit 25 is the above described exposed region. Of the entire region of the speaker unit 25, this exposed region is the region that is not hidden by the display unit 301 serving as the shielding member but is exposed to the user on the front side of the display unit 301, or is the region that can be seen from the user.

The speaker unit 25 disposed on the back side of the display unit 301 is designed to be able to move at least in a direction parallel to the direction indicated by an arrow W11 or in the upward/downward direction (vertical direction) relative to the user viewing the display unit 301, and in a direction parallel to the direction indicated by an arrow W12 or in a rightward/leftward (horizontal direction) relative to the user viewing the display unit 301. In other words, the speaker unit 25 is movable in at least two directions that are perpendicular to each other.

As described above, if the shape of the exposed region is long in one direction, for example, the directivity in that direction becomes higher, and sound tends to spread in the direction in which the exposed region is short.

In view of this, the speaker unit 25 is moved in the direction indicated by the arrow W12, for example, so that a partial region of the speaker unit 25, or a rectangular region that is long in the vertical direction, is exposed on the left side of the display unit 301 in the drawing, and is set as the exposed region. In this case, sound that has a high directivity in the vertical direction in the drawing and spreads in the horizontal direction in the drawing is output from the speaker unit 25.

Also, if the speaker unit 25 is further moved in the direction indicated by the arrow W12 in this situation, the width of the exposed region in the vertical direction in the drawing does not change, but the width in the lateral direction becomes greater. That is, the ratio of the width in the vertical direction to the width in the lateral direction in the exposed region in the drawing becomes lower.

Accordingly, the directivity in the vertical direction in the sound output from the speaker unit 25 in the drawing is made lower than that before the speaker unit 25 is moved. In other words, the directivity in the vertical direction in the drawing in the sound output from the speaker unit 25 is made lower by the amount equivalent to the decrease in the ratio of the width in the vertical direction to the width in the lateral direction of the exposed region.

Also, in this case, it is possible to adjust the sound output position to a desired position by changing the height of the speaker unit 25 in the vertical direction in the drawing. For example, if the position of the speaker unit 25 in the vertical direction is changed in accordance with the position of a user or the like detected by the sensor 271, it is possible to perform control such as outputting sound from a position at the same height as the user's ears.

Likewise, the speaker unit 25 is moved in the direction indicated by the arrow W11, for example, so that a partial region of the speaker unit 25, or a rectangular region that is long in the lateral direction, is exposed on the upper left side of the display unit 301 in the drawing, and is set as the exposed region. In this case, sound that has a high directivity in the horizontal direction in the drawing and spreads in the vertical direction in the drawing is output from the speaker unit 25.

Also, if the speaker unit 25 is further moved in the direction indicated by the arrow W11 in this situation, the width of the exposed region in the lateral direction in the drawing does not change, but the width in the vertical direction becomes greater. Accordingly, the directivity in the horizontal direction in the sound output from the speaker unit 25 in the drawing is made lower than that before the speaker unit 25 is moved. Further, in this case, it is possible to adjust the sound output position to a desired position in the horizontal direction by changing the position of the speaker unit 25 in the horizontal direction in the drawing. In this case, if the position of the speaker unit 25 in the horizontal direction in the drawing is set in accordance with the position of a user detected by the sensor 271, for example, it is possible to perform control such as outputting sound from a position in front of the user.

As described above, the speaker unit 25 is moved relative to the display unit 301, and the shape, the size, and the like of the exposed region are appropriately changed. Thus, the directivity in the horizontal direction and the vertical direction can be controlled for the user viewing the display unit 301 from the front.

Note that, at a time of sound reproduction by the speaker unit 25, sound may be output from only some of the speakers 51 constituting the speaker unit 25, or sound may be output from all the speakers 51. Particularly, sound may be output not only from the speakers 51 disposed in the exposed region but also from the speakers 51 hidden by the display unit 301 serving as the shielding member.

Although an example in which the speakers 51 are arranged in a square form to form the speaker unit 25 has been described above, the speakers 51 may also be arranged in any desired form. For example, the speakers 51 may be arranged in a rectangular form or a substantially circular form. Each speaker 51 may also have any shape such as a rectangular shape or a substantially circular shape.

Second Specific Example Application of the Present Technology

Figure 14:
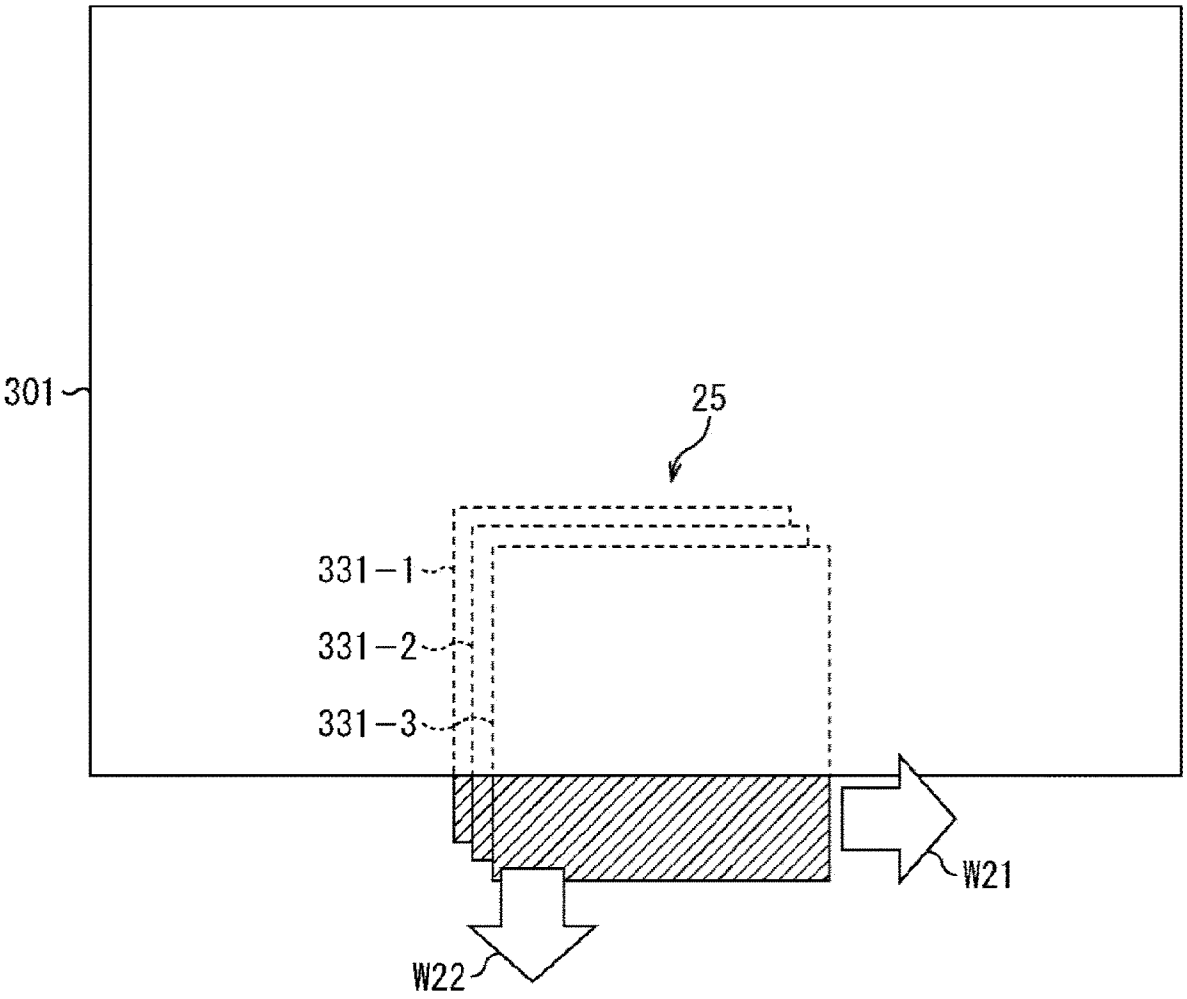
FIG. 14 is a diagram showing an example application of the present technology to a television receiver.

Further, in a case where the present technology is applied to a television receiver, the example shown in FIG. 13 is not necessarily adopted, and the configuration shown in FIG. 14 may be adopted, for example. Note that, in FIG. 14, the components equivalent to those shown in FIG. 13 are denoted by the same reference numerals as those used in FIG. 13, and explanation of them will not be unnecessarily repeated. Also, in the example shown in FIG. 14, the blocks corresponding to the sensor 271 through the movable unit 273 shown in FIG. 11, or the blocks other than the speaker unit 25, are not shown.

In the example shown in FIG. 14, a television receiver includes a display unit 301 and a speaker unit 25 disposed on the back side of the display unit 301.

In this example, a plurality of speakers 51 (not shown) are arranged in a square form in a plane, to form a speaker subunit 331-1. Likewise, a speaker subunit 331-2 and a speaker subunit 331-3 are also formed with a plurality of speakers 51 (not shown) arranged in a square form in a plane.

In addition, the three speaker subunits 331-1 through 331-3 are stacked in a front direction in the drawing, or in a direction perpendicular to each of the planar speaker subunits. In this manner, one speaker unit 25 is formed. Note that, hereinafter, where there is no particular need to distinguish the speaker subunits 331-1 through 331-3 from one another, the speaker subunits 331-1 through 331-3 will be also referred to simply as the speaker subunits 331.

For example, all the speakers 51 constituting the speaker unit 25 can be connected in parallel to one amplifier 23 via a switching unit 24. Alternatively, an amplifier may be provided for each speaker subunit 331, and all the speakers 51 constituting the speaker subunits 331 can be connected in parallel to one amplifier via a switching unit.

FIG. 14 shows the display unit 301 viewed from the front by a user, and the speaker unit 25 is disposed behind the display unit 301 as viewed from the user. Specifically, in this example, the display unit 301 is the above described shielding member, and part of or all the speaker unit 25 is hidden behind the display unit 301 and cannot be seen from the user, depending on the position of the speaker unit 25.

Particularly, the speaker unit 25 is disposed at the center on the lower side of the display unit 301 in the drawing. Also, each of the shaded portions of the speaker unit 25 is the above described exposed region.

The speaker unit 25 disposed on the back side of the display unit 301 is designed to be able to move at least in a direction parallel to the direction indicated by an arrow W21 or in the rightward/leftward direction (horizontal direction) relative to the user viewing the display unit 301, and in a direction parallel to the direction indicated by an arrow W22 or in a upward/downward (vertical direction) relative to the user viewing the display unit 301. In other words, the speaker unit 25 is movable in at least two directions that are perpendicular to each other.

As described above, if the shape of the exposed region is long in one direction, for example, the directivity in that direction becomes higher, and sound tends to spread in the direction in which the exposed direction is short.

In view of this, the speaker unit 25 is moved in the direction indicated by the arrow W22, for example, so that a partial region of the speaker unit 25, or a rectangular region that is long in the lateral direction, is exposed on the lower side of the display unit 301 in the drawing, and is set as the exposed region. In this case, sound that has a high directivity in the horizontal direction in the drawing and spreads in the vertical direction in the drawing is output from the speaker unit 25.

Also, if the speaker unit 25 is further moved in the direction indicated by the arrow W22 in this situation, the width of the exposed region in the lateral direction in the drawing does not change, but the width in the vertical direction becomes greater. That is, the ratio of the width in the lateral direction to the width in the vertical direction in the exposed region in the drawing becomes lower.

Accordingly, the directivity in the horizontal direction in the sound output from the speaker unit 25 in the drawing is made lower than that before the speaker unit 25 is moved.

In other words, the directivity in the horizontal direction in the drawing in the sound output from the speaker unit 25 is made lower by the amount equivalent to the decrease in the ratio of the width in the lateral direction to the width in the vertical direction of the exposed region.

Likewise, if the speaker unit 25 is moved in a horizontal direction in the drawing, or in the direction indicated by the arrow W21, for example, it is possible to move a region in which sound has a high directivity in the horizontal direction.

Further, a plurality of speaker subunits 331 are stacked to form one speaker unit 25 in this example. Accordingly, it is possible to increase the sound pressure in the low frequency range of the sound to be output, without any increase in the plane area of the speaker unit 25. That is, even with the small speaker unit 25, sufficient sound pressure in the low frequency range can be secured.

Note that, although an example in which the entire speaker unit 25 is moved has been described with reference to FIG. 14, the movable unit 273 may be designed to be able to move the speaker subunits 331 independently of one another. In such a case, the size and the position of the exposed region can be adjusted with higher precision.

Directivity of Sound

The directivity of sound when only part of the speaker unit is exposed is now described.

Figure 15:
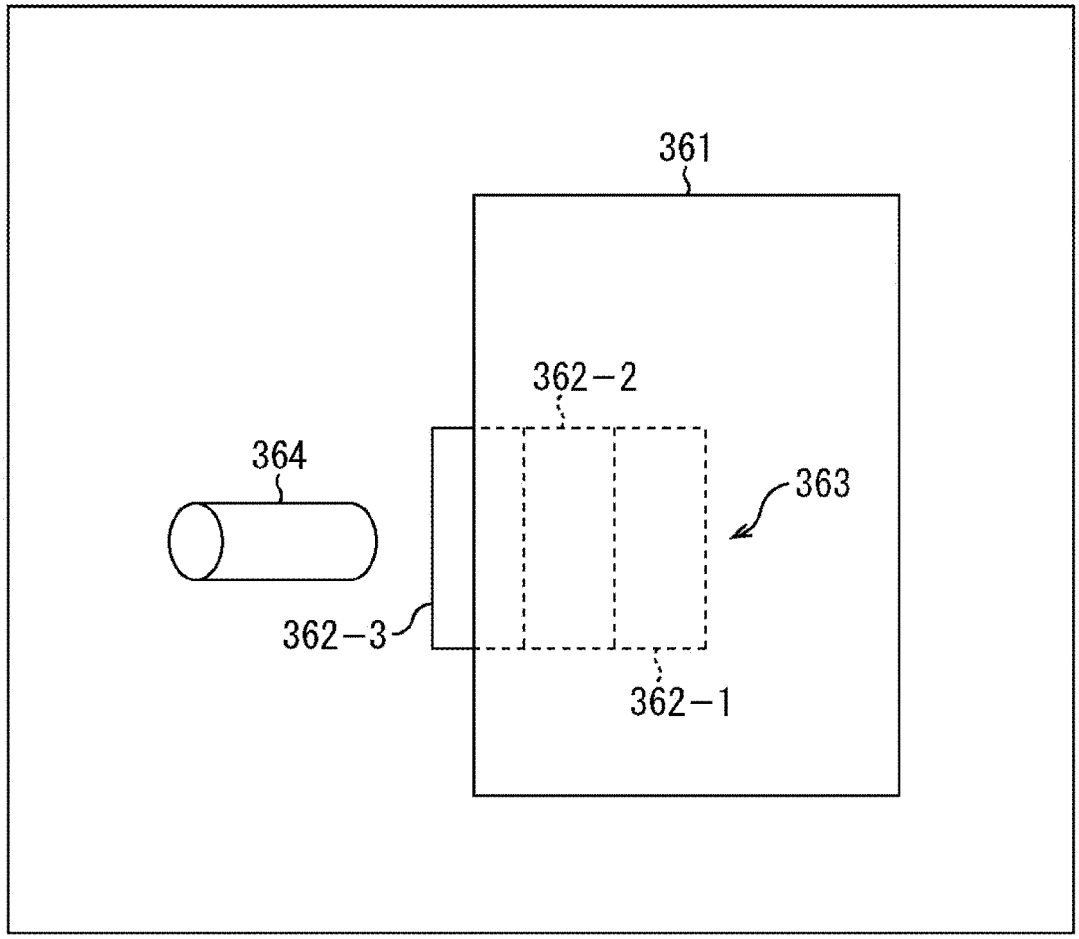
FIG. 15 is a diagram for explaining directivity of sound.

As shown in FIG. 15, for example, a shielding member 361 is provided, and a speaker unit 363 formed with three rectangular speakers 362-1 through 362-3 is disposed on the back side of the shielding member 361. Note that, hereinafter, where there is no particular need to distinguish the speakers 362-1 through 362-3 from one another, the speakers 362-1 through 362-3 will be also referred to simply as the speakers 362.

Here, the speakers 362 are speakers that have the characteristics of a capacitive load, corresponding to the speakers 51 shown in FIG. 11, for example.

In this example, the speaker unit 363 is disposed on the back side of the shielding member 361 in the drawing, so that, when the shielding member 361 is viewed from the front, part of the speaker unit 363 is hidden by the shielding member 361 and cannot be seen. Also, the speaker unit 363 is made to output sound, and frequency measurement is conducted from the front of the shielding member 361.

In this example, the rectangular speakers 362 that are long in the vertical direction in the drawing are arranged in the lateral direction in the drawing, to constitute the speaker unit 363. These three speakers 362 are connected in parallel to one amplifier (not shown). Further, the speaker unit 363 is disposed in such a manner that part of the speaker 362-3 of the three speakers 362 is exposed, and sound reproduction is performed so that sound is output from all the speakers 362.

Here, the region exposed in the speaker 362-3, or the exposed region, has a rectangular shape that is long in the vertical direction in FIG. 15. Hereinafter, the vertical direction of the exposed region in FIG. 15 will be also referred to as the long-side direction, and the lateral direction of the exposed region in FIG. 15 will be also referred to as the short-side direction.

Further, a microphone 364 to be used for measurement is disposed in front of the exposed region of the speaker unit 363.

Figure 16:
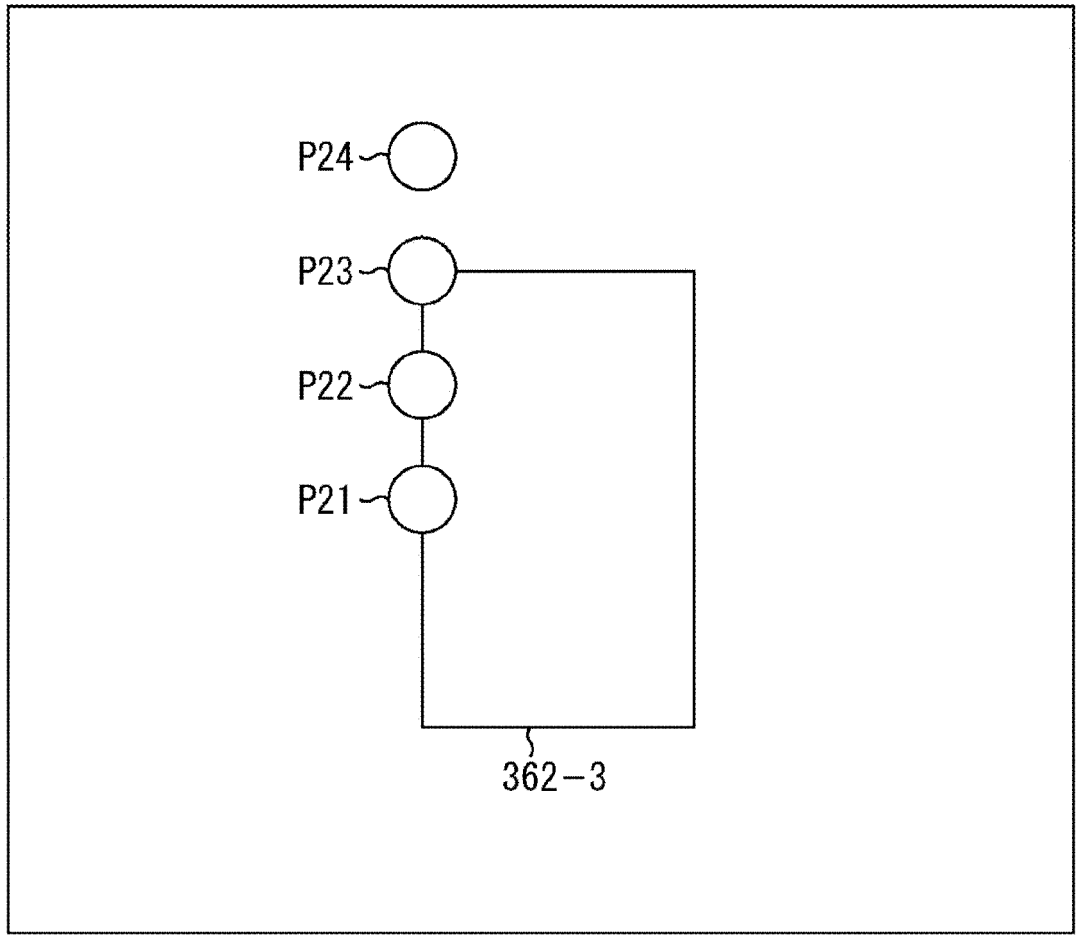
FIG. 16 is a diagram for explaining directivity of sound.

At a time of frequency measurement by the microphone 364, measurement is carried out at four positions facing the exposed speaker 362-3, as shown in FIG. 16. That is, the microphone 364 is moved to each of the four positions, and the measurement is carried out at each position. Note that, in FIG. 16, the components equivalent to those shown in FIG. 15 are denoted by the same reference numerals as those used in FIG. 15, and explanation of them will not be unnecessarily repeated.

In the example shown in FIG. 16, a position that faces the approximate center position on the left edge in the drawing of the exposed speaker 362-3 is set as a position P21, and a position that is located substantially in the middle between the position P21 and the upper end of the speaker 362-3 in the drawing is set as a position P22.

In addition to that, the vertex portion on the leftmost side of the upper end of the speaker 362-3 in the drawing is set as a position P23, and a position located above the position P23 in the drawing is set as a position P24.

Here, the positions P21 through P24 are the same positions in the lateral direction or the short-side direction in the drawing, and these positions P21 through P24 are aligned at regular intervals in the vertical direction or the long-side direction in the drawing.

All the three speakers 362 were made to output sound in the state shown in FIG. 15, which is a state in which part of the speaker 362-3 is exposed through the shielding member 361. Frequency measurement was then carried out at the respective positions of the positions P21 through P24 shown in FIG. 16. As a result, the measurement results shown in FIGS. 17 and 18 were obtained, for example. Note that, in FIGS. 17 and 18, the ordinate axis indicates sound pressure, and the abscissa axis indicates frequency.

Figure 17:
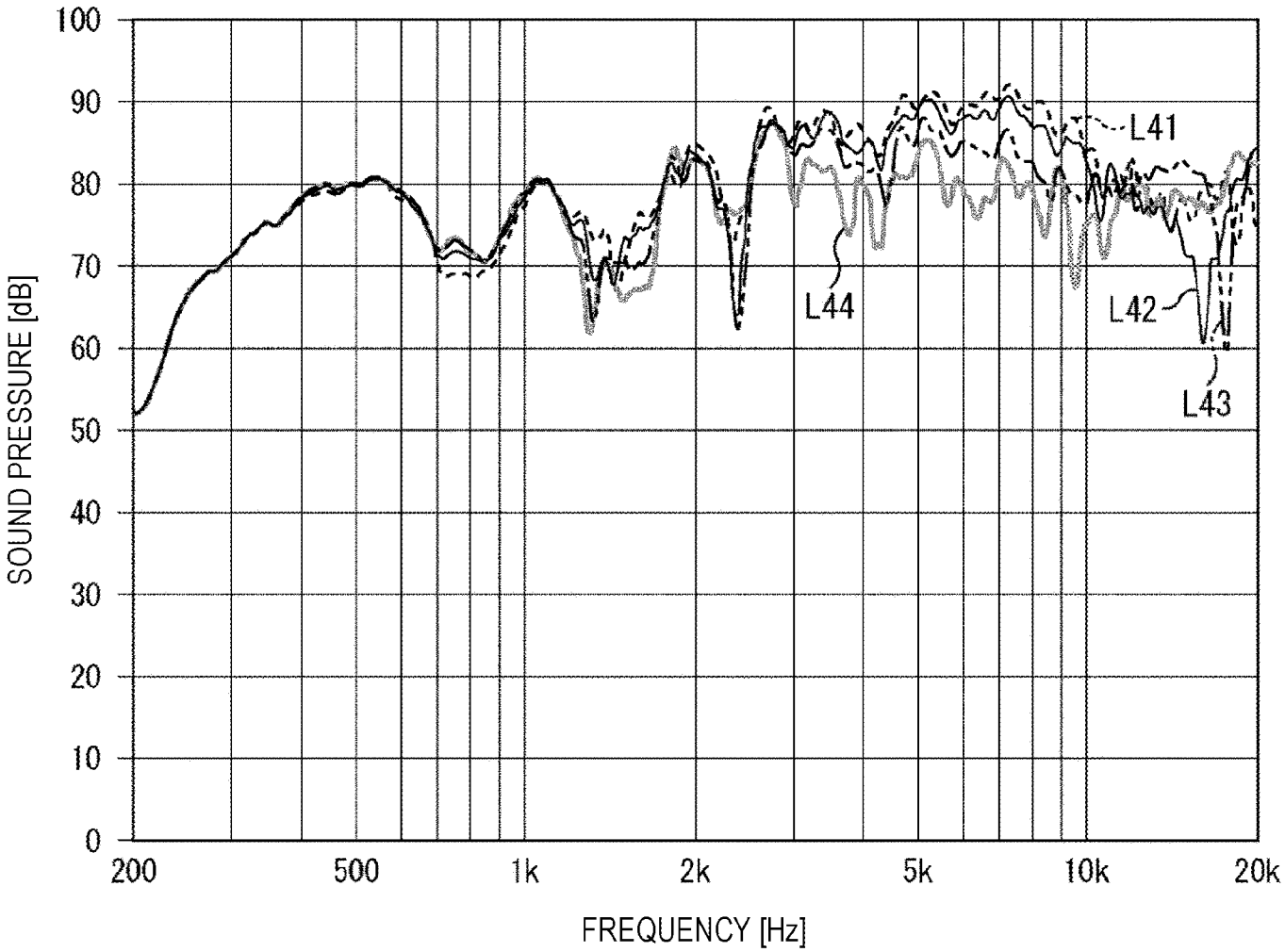
FIG. 17 is a diagram for explaining directivity of sound.

FIG. 17 shows the results of measurement carried out at the respective positions when the width of the exposed region of the speaker unit 363 in the short-side direction was 5 cm. Specifically, curves L41 through L44 indicate the results of sound pressure measurement at the positions P21 through P24.

Figure 18:
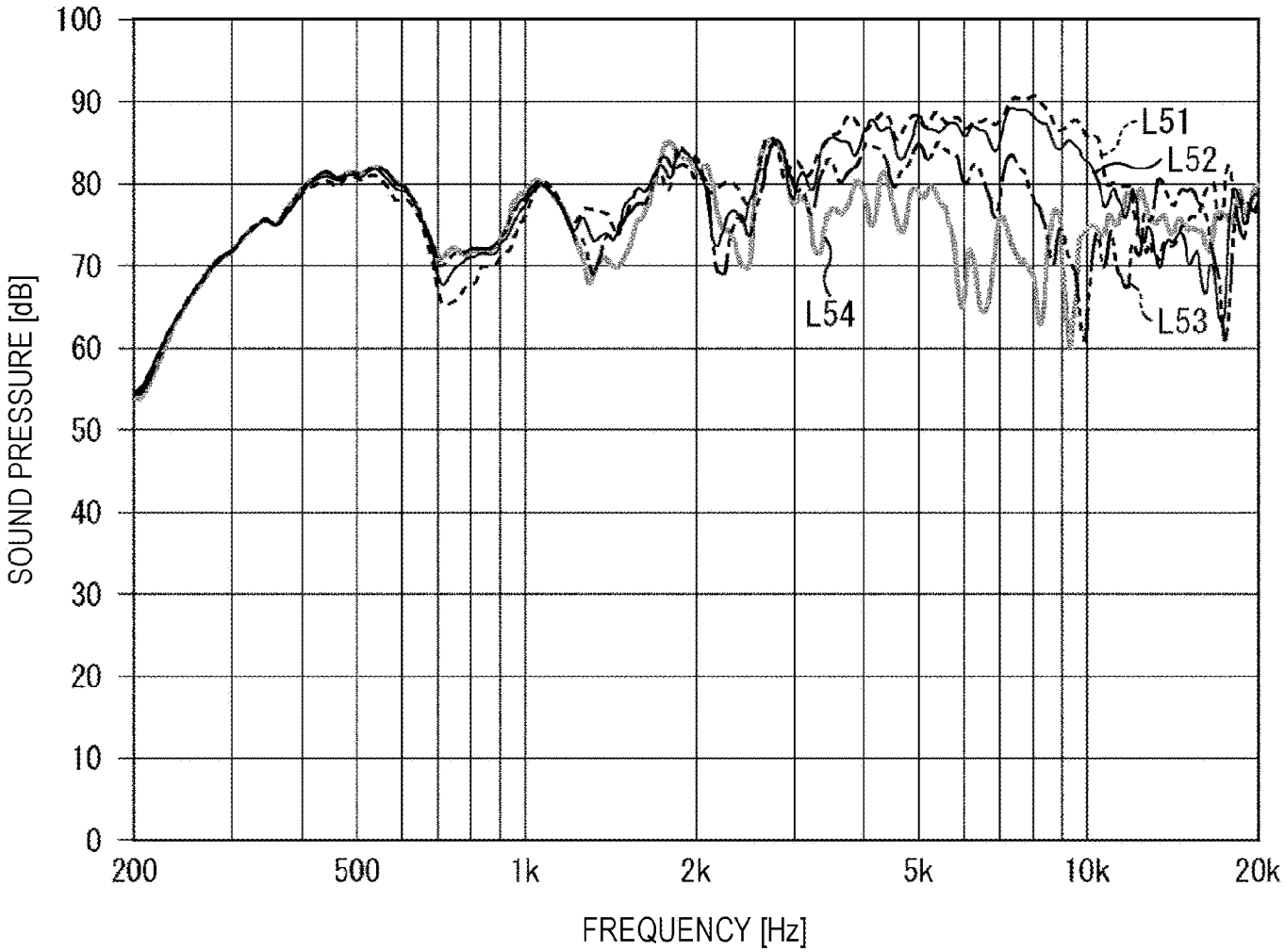
FIG. 18 is a diagram for explaining directivity of sound.

Further, FIG. 18 shows the results of measurement carried out at the respective positions when the width of the exposed region of the speaker unit 363 in the short-side direction was 2.5 cm. Specifically, curves L51 through L54 indicate the results of sound pressure measurement at the positions P21 through P24.

As can be seen from comparisons between the measurement results shown in FIG. 17 and the measurement results shown in FIG. 18, the frequency characteristics achieved when the width of the exposed region was 2.5 cm as shown in FIG. 18 have larger decreases in the sound pressure in the high-frequency range at the position P23 and the position P24 than those of the frequency characteristics achieved when the width of the exposed region was 5 cm as shown in FIG. 17. That is, if the width of the exposed region in the lateral direction in FIG. 15 becomes smaller, and the exposed region becomes longer in the vertical direction, the directivity of sound in the long-side direction of the exposed region, or in the vertical direction in FIG. 15, becomes higher in the high frequency range.

On the other hand, at the positions P21 and P22, there is no significant difference in measurement results between the case where the width of the exposed region was 5 cm and the case where the width was 2.5 cm.

When the measurement results in the case where the width of the exposed region was 5 cm are compared with the measurement results in the case where the width of the exposed region was 2.5 cm as described above, sound with attenuated sound pressure in the high-frequency range is clearly heard if the width of the exposed region is changed at a position far from the center of the exposed region in the long-side direction. Therefore, it is possible to make the listener feel more clearly such directivity that the sound source is not directed to the listener.

As can be seen from the above, in a case where part of the speaker unit 363 is exposed, the directivity is high in the longitudinal direction of the exposed region, while the directivity is low in the short direction in which sound tends to spread.

Therefore, in the sound reproducing apparatus 261 shown in FIG. 11, the speaker unit 25 is moved in accordance with instruction information, so that the shape and the size of the exposed region are changed. Thus, the direction in which directivity is given, the intensity of the directivity, and increase/decrease in sound pressure can be controlled.

Meanwhile, the above described series of processes may be performed by hardware or may be performed by software. Where the series of processes are to be performed by software, the program that forms the software is installed into a computer. Here, the computer may be a computer incorporated into special-purpose hardware, or may be, for example, a general-purpose computer or the like that can execute various kinds of functions if various kinds of programs are installed thereinto.

Figure 19:
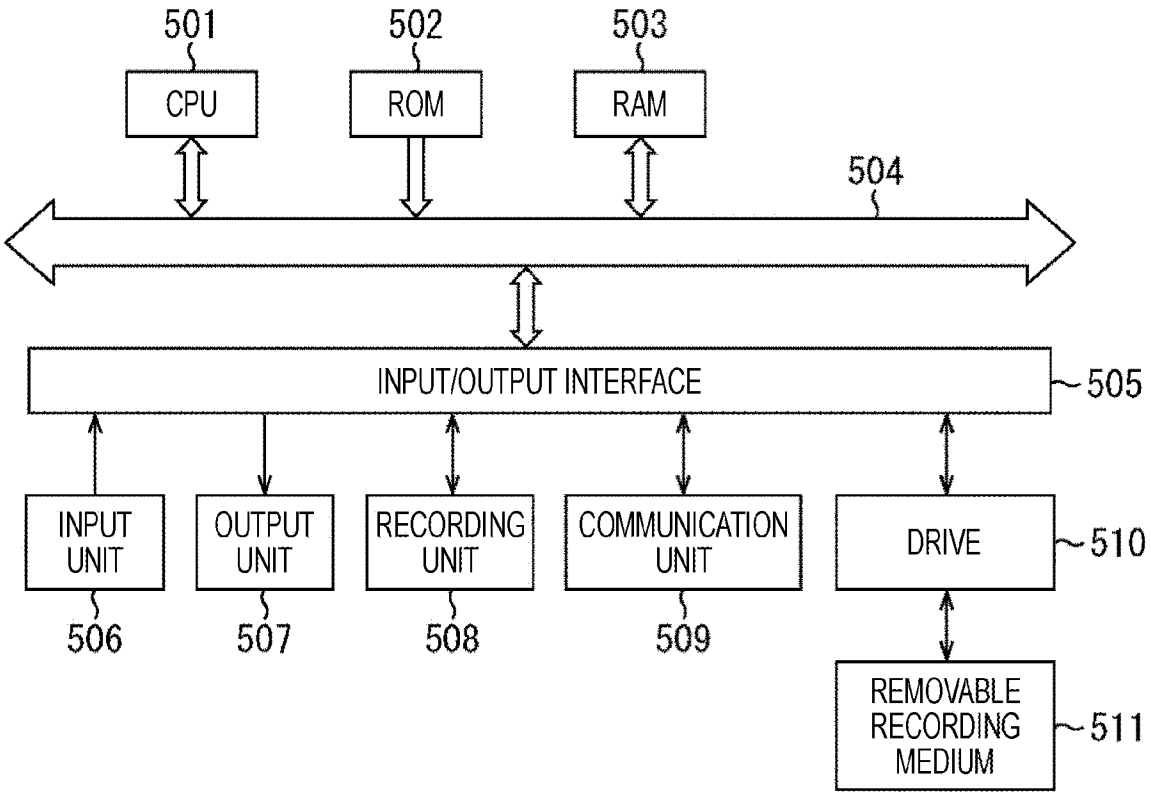
FIG. 19 is a diagram showing an example configuration of a computer.

FIG. 19 is a block diagram showing an example configuration of the hardware of a computer that performs the above described series of processes in accordance with a program.

In the computer, a central processing unit (CPU) 501, a read only memory (ROM) 502, and a random access memory (RAM) 503 are connected to one another by a bus 504.

An input/output interface 505 is further connected to the bus 504. An input unit 506, an output unit 507, a recording unit 508, a communication unit 509, and a drive 510 are connected to the input/output interface 505.

The input unit 506 is formed with a keyboard, a mouse, a microphone, an imaging device, and the like. The output unit 507 is formed with a display, a speaker, and the like. The recording unit 508 is formed with a hard disk, a nonvolatile memory, or the like. The communication unit 509 is formed with a network interface or the like. The drive 510 drives a removable recording medium 511 such as a magnetic disc, an optical disc, a magnetooptical disc, or a semiconductor memory.

In the computer having the above configuration, the CPU 501 loads a program recorded on the recording unit 508 into the RAM 503 via the input/output interface 505 and the bus 504, for example, and executes the program, so that the above described series of processes are performed.

The program to be executed by the computer (the CPU 501) may be recorded on the removable recording medium 511 as a packaged medium and the like, and be then provided, for example. Alternatively, the program can be provided via a wired or wireless transmission medium, such as a local area network, the Internet, or digital satellite broadcasting.

In the computer, the program can be installed into the recording unit 508 via the input/output interface 505 when the removable recording medium 511 is mounted on the drive 510. The program can also be received by the communication unit 509 via a wired or wireless transmission medium, and be installed into the recording unit 508. Alternatively, the program may be installed beforehand into the ROM 502 or the recording unit 508.

It should be noted that the program to be executed by the computer may be a program for performing processes in chronological order in accordance with the sequence described in the present specification, or may be a program for performing processes in parallel or performing a process when necessary, such as when there is a call.

Further, embodiments of the present technology are not limited to the above described embodiments, and various modifications may be made to them without departing from the scope of the present technology.

For example, the present technology can be embodied in a cloud computing configuration in which one function is shared among a plurality of devices via a network, and processing is performed by the devices cooperating with one another.

Further, the respective steps described with reference to the above described flowcharts can be carried out by one device or can be shared among a plurality of devices.

Furthermore, in a case where more than one process is included in one step, the plurality of processes included in the step can be performed by one device or can be shared among a plurality of devices.

In addition, the advantageous effects described in this specification are merely examples, and the advantageous effects of the present technology are not limited to them and may include other effects.

Further, the present technology may also be embodied in the configurations described below.

(1)

A sound reproducing apparatus including:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit.

(2)

The sound reproducing apparatus according to (1), further including an instruction unit that outputs instruction information for controlling directivity, in which the switching unit switches connections of the electroacoustic transducers in accordance with the instruction information.

(3)

The sound reproducing apparatus according to (1) or (2), in which the switching unit connects a plurality of the electroacoustic transducers in parallel to the amplification unit.

(4)

The sound reproducing apparatus according to (2), further including a signal processing unit that performs signal processing on the acoustic signal, in accordance with the instruction information.

(5)

The sound reproducing apparatus according to (4), in which, in accordance with the instruction information, the signal processing unit performs the signal processing depending on characteristics, the number, or positions of the electroacoustic transducers connected to the amplification unit by the switching unit.

(6)

The sound reproducing apparatus according to (4) or (5), in which, in accordance with the instruction information, the signal processing unit further performs a protection process to protect the electroacoustic transducers connected to the amplification unit by the switching unit.

(7)

The sound reproducing apparatus according to (6), in which the signal processing unit performs a process of attenuating a component of the acoustic signal as the protection process, the component being not lower than a predetermined frequency.

(8)

The sound reproducing apparatus according to any of (1) to (7), further including an electroacoustic transduction unit formed with a plurality of subunits overlapped on one another, each of the subunits being formed with a plurality of the electroacoustic transducers aligned, in which the switching unit switches connections of the electroacoustic transduction unit, to connect one or a plurality of electroacoustic transducers among the electroacoustic transducers constituting the electroacoustic transduction unit to the amplification unit.

(9)

The sound reproducing apparatus according to (2), further including a detection unit that detects a user near the sound reproducing apparatus, in which the instruction unit outputs the instruction information corresponding to a result of the detection performed by the detection unit.

(10)

A sound reproduction method implemented in a sound reproducing apparatus including:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit, the sound reproduction method including steps of:

the amplification unit amplifying the acoustic signal;

the switching unit switching connections of the electroacoustic transducers; and the electroacoustic transducers outputting sound in accordance with the acoustic signal.

(11)

A program for causing a computer to perform a process, the computer controlling a sound reproducing apparatus including:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit, the process including steps of:

causing the amplification unit to amplify the acoustic signal;

causing the switching unit to switch connections of the electroacoustic transducers; and causing the electroacoustic transducers to output sound in accordance with the acoustic signal.

(12)

A sound reproducing apparatus including:

an amplification unit that amplifies an acoustic signal;

an electroacoustic transduction unit that has characteristics of a capacitive load, and outputs sound in accordance with the acoustic signal output from the amplification unit; and a movable unit that moves the electroacoustic transduction unit.

(13)

The sound reproducing apparatus according to (12), further including an instruction unit that outputs instruction information for controlling directivity, in which the movable unit moves the electroacoustic transduction unit in accordance with the instruction information.

(14)

The sound reproducing apparatus according to (12) or (13), in which the electroacoustic transduction unit is movable at least in a first direction and a second direction perpendicular to each other.

(15)

The sound reproducing apparatus according to any of (12) to (14), in which the electroacoustic transduction unit is disposed to hide part of or all the electroacoustic transduction unit behind a shielding member when viewed from a predetermined direction, and the movable unit changes a relative position of the electroacoustic transduction unit with respect to the shielding member.

(16)

The sound reproducing apparatus according to any of (12) to (15), in which the electroacoustic transduction unit includes a plurality of electroacoustic transducers that output sound in accordance with the acoustic signal output from the amplification unit, the electroacoustic transducers having characteristics of a capacitive load, and the sound reproducing apparatus further includes a switching unit that switches connections of the electroacoustic transducers to the amplification unit, to connect one or a plurality of electroacoustic transducers among the plurality of electroacoustic transducers to the amplification unit.

(17)

The sound reproducing apparatus according to (16), in which the electroacoustic transduction unit is formed with a plurality of subunits overlapped on one another, each of the subunits being formed with a plurality of the electroacoustic transducers aligned.

(18)

The sound reproducing apparatus according to (13), further including a detection unit that detects a user near the sound reproducing apparatus, in which the instruction unit outputs the instruction information corresponding to a result of the detection performed by the detection unit.

(19)

The sound reproducing apparatus according to (13) or (18), further including a signal processing unit that performs signal processing on the acoustic signal, in accordance with the instruction information.

(20)

A sound reproduction method implemented in a sound reproducing apparatus including:

an amplification unit that amplifies an acoustic signal;

an electroacoustic transduction unit that has characteristics of a capacitive load and outputs sound in accordance with the acoustic signal output from the amplification unit; and a movable unit that moves the electroacoustic transduction unit, the sound reproduction method including steps of:

the amplification unit amplifying the acoustic signal;

the movable unit moving the electroacoustic transduction unit; and the electroacoustic transduction unit outputting sound in accordance with the acoustic signal.

(21)

A program for causing a computer to perform a process, the computer controlling a sound reproducing apparatus including:

an amplification unit that amplifies an acoustic signal;

an electroacoustic transduction unit that has characteristics of a capacitive load and outputs sound in accordance with the acoustic signal output from the amplification unit; and a movable unit that moves the electroacoustic transduction unit, the process including steps of:

causing the amplification unit to amplify the acoustic signal;

causing the movable unit to move the electroacoustic transduction unit; and causing the electroacoustic transduction unit to output sound in accordance with the acoustic signal.

REFERENCE SIGNS LIST

11 Sound reproducing apparatus
21 Instruction unit
23 Amplifier
24 Switching unit
25 Speaker unit
31 Acoustic characteristics correction unit
32 High-frequency protection unit
51-1 through **51-*n*, 51** Speaker
261 Sound reproducing apparatus
271 Sensor
272 Instruction information generation unit
273 Movable unit

The invention claimed is:

1. A sound reproducing apparatus comprising:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit.

2. The sound reproducing apparatus according to claim 1, further comprising an instruction unit that outputs instruction information for controlling directivity, wherein the switching unit switches connections of the electroacoustic transducers in accordance with the instruction information.

3. The sound reproducing apparatus according to claim 2, further comprising a signal processing unit that performs signal processing on the acoustic signal, in accordance with the instruction information.

4. The sound reproducing apparatus according to claim 3, wherein, in accordance with the instruction information, the signal processing unit performs the signal processing depending on characteristics, the number, or positions of the electroacoustic transducers connected to the amplification unit by the switching unit.

5. The sound reproducing apparatus according to claim 3, wherein, in accordance with the instruction information, the signal processing unit further performs a protection process to protect the electroacoustic transducers connected to the amplification unit by the switching unit.

6. The sound reproducing apparatus according to claim 5, wherein the signal processing unit performs a process of attenuating a component of the acoustic signal as the protection process, the component being not lower than a predetermined frequency.

7. The sound reproducing apparatus according to claim 2, further comprising a detection unit that detects a user near the sound reproducing apparatus, wherein the instruction unit outputs the instruction information corresponding to a result of the detection performed by the detection unit.

8. The sound reproducing apparatus according to claim 1, wherein the switching unit connects a plurality of the electroacoustic transducers in parallel to the amplification unit.

9. The sound reproducing apparatus according to claim 1, further comprising an electroacoustic transduction unit formed with a plurality of subunits overlapped on one another, each of the subunits being formed with a plurality of the electroacoustic transducers aligned, wherein the switching unit switches connections of the electroacoustic transduction unit, to connect one or a plurality of electroacoustic transducers among the electroacoustic transducers constituting the electroacoustic transduction unit to the amplification unit.

10. A sound reproduction method implemented in a sound reproducing apparatus including:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit, the sound reproduction method comprising steps of:

the amplification unit amplifying the acoustic signal;

the switching unit switching connections of the electroacoustic transducers; and the electroacoustic transducers outputting sound in accordance with the acoustic signal.

11. A non-transitory computer readable medium storing instructions that, when executed by a computer, perform a process for controlling a sound reproducing apparatus, the sound reproducing apparatus including:

an amplification unit that amplifies an acoustic signal;

a plurality of electroacoustic transducers that output sound in accordance with the acoustic signal output from the amplification unit, the electroacoustic transducers having characteristics of a capacitive load; and a switching unit that switches connections of the electroacoustic transducers to the amplification unit, to connect one or a plurality of electroacoustic transducers among the plurality of electroacoustic transducers to the amplification unit, the process including steps of:

causing the amplification unit to amplify the acoustic signal;

causing the switching unit to switch connections of the electroacoustic transducers; and causing the electroacoustic transducers to output sound in accordance with the acoustic signal.

12. A sound reproducing apparatus comprising:

an amplification unit that amplifies an acoustic signal;

an electroacoustic transduction unit that has characteristics of a capacitive load, and outputs sound in accordance with the acoustic signal output from the amplification unit;

a movable unit that moves the electroacoustic transduction unit; and an instruction unit that outputs instruction information for controlling directivity, wherein the movable unit moves the electroacoustic transduction unit in accordance with the instruction information.

13. The sound reproducing apparatus according to claim 12, wherein the electroacoustic transduction unit is movable at least in a first direction and a second direction perpendicular to each other.

14. The sound reproducing apparatus according to claim 12, wherein the electroacoustic transduction unit is disposed to hide part of or all the electroacoustic transduction unit behind a shielding member when viewed from a predetermined direction, and the movable unit changes a relative position of the electroacoustic transduction unit with respect to the shielding member.

15. The sound reproducing apparatus according to claim 12, wherein the electroacoustic transduction unit includes a plurality of electroacoustic transducers that output sound in accordance with the acoustic signal output from the amplification unit, the electroacoustic transducers having characteristics of a capacitive load, and the sound reproducing apparatus further comprises a switching unit that switches connections of the electroacoustic transducers to the amplification unit, to connect one or a plurality of electroacoustic transducers among the plurality of electroacoustic transducers to the amplification unit.

16. The sound reproducing apparatus according to claim 15, wherein the electroacoustic transduction unit is formed with a plurality of subunits overlapped on one another, each of the subunits being formed with a plurality of the electroacoustic transducers aligned.

17. The sound reproducing apparatus according to claim 12, further comprising a detection unit that detects a user near the sound reproducing apparatus, wherein the instruction unit outputs the instruction information corresponding to a result of the detection performed by the detection unit.

18. The sound reproducing apparatus according to claim 12, further comprising a signal processing unit that performs signal processing on the acoustic signal, in accordance with the instruction information.

19. A sound reproduction method implemented in a sound reproducing apparatus including:

an amplification unit that amplifies an acoustic signal;

an electroacoustic transduction unit that has characteristics of a capacitive load and outputs sound in accordance with the acoustic signal output from the amplification unit;

a movable unit that moves the electroacoustic transduction unit; and an instruction unit that outputs instruction information for controlling directivity, the sound reproduction method comprising steps of:

the amplification unit amplifying the acoustic signal;

the movable unit moving the electroacoustic transduction unit in accordance with the instruction information; and the electroacoustic transduction unit outputting sound in accordance with the acoustic signal.

20. A non-transitory computer readable medium storing instructions that, when executed by a computer, perform a process for controlling a sound reproducing apparatus, the sound reproducing apparatus including:

an amplification unit that amplifies an acoustic signal;

an electroacoustic transduction unit that has characteristics of a capacitive load and outputs sound in accordance with the acoustic signal output from the amplification unit;

a movable unit that moves the electroacoustic transduction unit; and an instruction unit that outputs instruction information for controlling directivity, the process including steps of:

causing the amplification unit to amplify the acoustic signal;

causing the movable unit to move the electroacoustic transduction unit in accordance with the instruction information; and causing the electroacoustic transduction unit to output sound in accordance with the acoustic signal.

* * * * *